US005193919A

United States Patent [19]

Godo et al.

[11] Patent Number: 5,193,919

[45] Date of Patent: Mar. 16, 1993

[54] TAPE PRINTER

[75] Inventors: Hiroki Godo; Tsutomu Yamazaki; Masaaki Ito, all of Suwa, Japan

[73] Assignee: Seiko Epson Corporation, Tokyo, Japan

[21] Appl. No.: 609,501

[22] Filed: Nov. 6, 1990

[30] Foreign Application Priority Data

Nov. 9, 1989 [JP] Japan ..... 1-292055
Nov. 25, 1989 [JP] Japan ..... 1-136249[U]
Nov. 25, 1989 [JP] Japan ..... 1-305237

[51] Int. Cl.[5] ..... B41J 2/325

[52] U.S. Cl. ..... 400/120; 400/208; 400/690.4; 156/384

[58] Field of Search ..... 400/120, 55, 59, 207, 400/208, 208.1, 690.4, 691, 690, 692, 693, 693.1; 101/288; 156/384, 387, 277, 386

[56] References Cited

U.S. PATENT DOCUMENTS 4,641,980 2/1987 Matsumoto et al. ..... 400/693
4,776,714 10/1988 Sugiura et al. ..... 400/208
4,780,011 10/1988 Hasegawa ..... 400/208
4,798,486 1/1989 Kaneko ..... 400/208
4,832,514 5/1989 Basile ..... 400/120
4,838,713 6/1989 Kunimitsu et al. ..... 400/120
4,840,504 6/1989 Chu et al. ..... 400/208
4,848,945 7/1989 Sone ..... 400/692
4,927,278 5/1990 Kuzuya et al. ..... 400/208
4,974,977 12/1990 Morgan et al. ..... 400/208
5,009,530 4/1991 Kuzuya et al. ..... 400/120
5,022,771 6/1991 Pague ..... 400/120
5,028,934 7/1991 Kasai et al. ..... 400/120
5,069,557 12/1991 Kuzuya et al. ..... 400/120

FOREIGN PATENT DOCUMENTS 213184 9/1986 Japan ..... 400/692

*Primary Examiner*—Edgar S. Burr
*Assistant Examiner*—Christopher A. Bennett
*Attorney, Agent, or Firm*—Blum Kaplan

[57] ABSTRACT

A tape printer for printing on a tape contained within a tape cassette. The tape cassette is insertable in and removable from the tape printer. The tape printer includes a housing and a printing mechanism supported on the housing for selectively printing on the tape. The printer also includes a tape conveying mechanism supported on the housing for conveying the tape across the printing mechanism. The printing mechanism and tape conveying mechanism are displaceable between first operative positions and second disengaged positions. A cover is pivotably supported on the housing. A coupling mechanism couples the cover to the printing and tape conveying mechanisms. The cover is displaceable between a first open position to actuate the coupling mechanism to move the printing and tape conveying mechanisms to their second disengaged positions and a second closed position to actuate the coupling mechanism to move the printing and tape conveying mechanisms to their first operative positions.

46 Claims, 16 Drawing Sheets

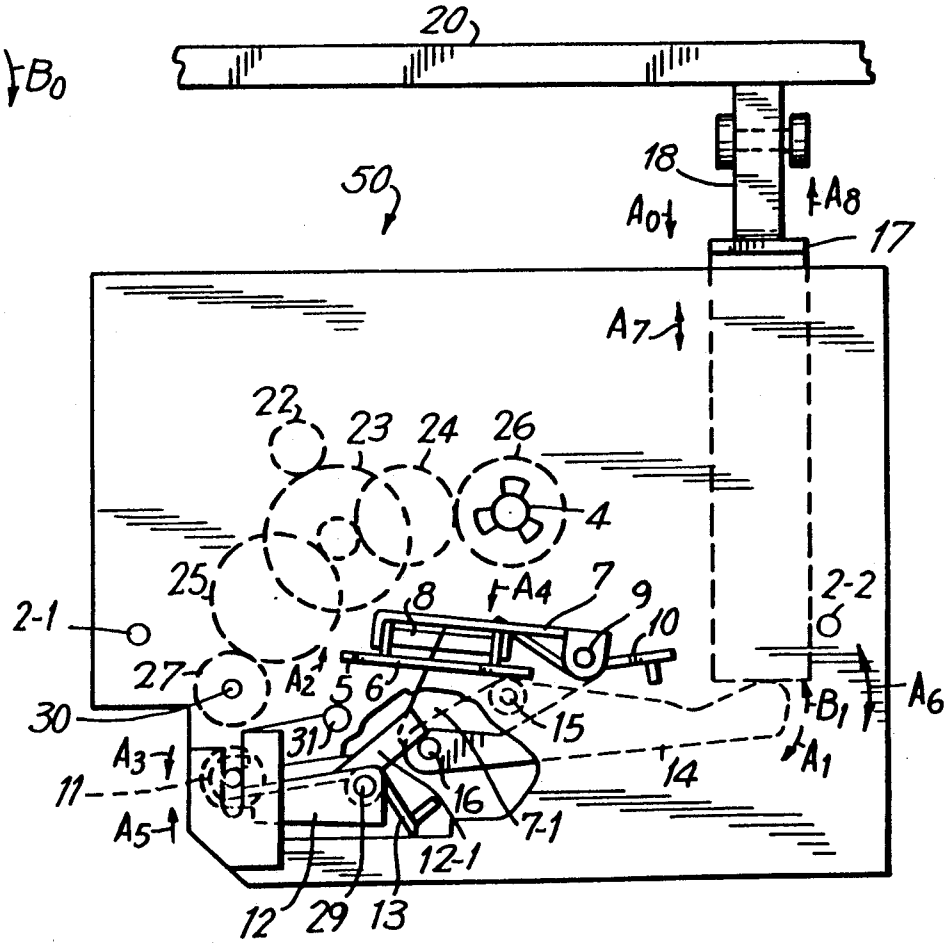
FIG.B
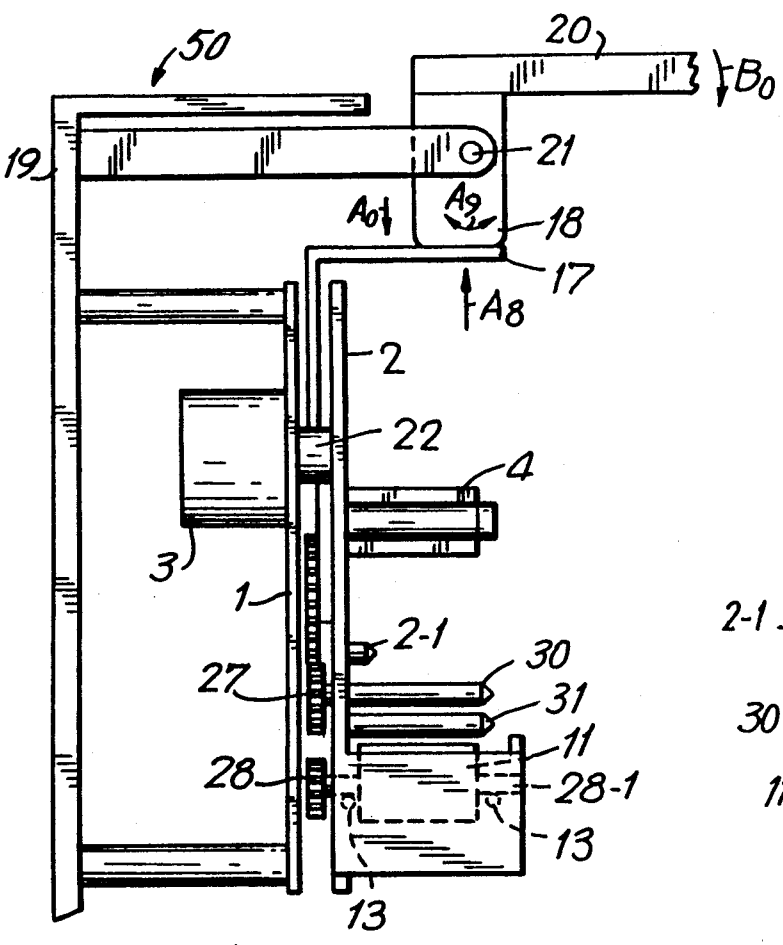
FIG.A

TAPE PRINTER

BACKGROUND OF THE INVENTION

This invention relates generally to a tape printing apparatus and, in particular, to a tape printer which employs a ribbon to print on a tape contained within a tape cassette. Tape conveying and printing mechanisms in the printer are moved automatically when the cover of the printer is opened to facilitate easy replacement of the tape and ribbon.

Tape printers which print letters on a strip of tape and which have replaceable tape and ribbon cassettes are known in the prior art. The prior art devices, however, have not allowed for easy removal of the tape and ribbon cassettes.

In one such device, the ribbon and tape cassettes are removed by first opening the cover of the printer. A separate lever must be activated to displace the driving mechanism and printer head to a position where the ribbon cassette can be removed. When the tape and ribbon cassettes are to be replaced, the lever is activated manually to displace the driving mechanism and printing head to the operative position whereby printing can occur and the cassettes can not be removed.

Another such device, allows removal of the tape cassette in a similar fashion but only after removal of the ribbon cassette.

U.S. Pat. Nos. 4,832,514 and 4,836,697 disclose a tape printer in which the tape and ribbon are provided in a tape cassette. The tape cassette is moved into operative position in the housing when the cover is closed. Such a system has proven less than completely satisfactory.

The removal and reloading procedure is both complicated and time consuming, mainly due to the fact that the cassettes are attached to the printing apparatus and can only be removed upon activation of a separate lever. Also, the tape cassette cannot be replaced without replacing the ribbon cassette.

Another drawback is that the prior art printers do not accept tapes with varying widths.

Accordingly, it is desired to provide a tape printer which overcomes the shortcomings of the prior art devices as described above, allows easy loading of the tape and ribbon cassettes into the tape printer and allows the loading of tape cassettes with tape of varying width.

SUMMARY OF THE INVENTION

Generally speaking, in accordance with the present invention, a tape printer for printing on a tape contained within a tape cassette, is provided. The tape cassette is insertable in and removable from the tape printer. The tape printer includes a housing, a printing mechanism supported on the housing for selectively printing on the tape and a tape conveying mechanism supported on the housing for conveying the tape across the printing mechanism. The printing mechanism is displaceable between a first position where the printing mechanism is adjacent the tape for printing thereon and a second position where the printing mechanism is disengaged from the tape. The tape conveying mechanism is displaceable between a first position where the tape conveying mechanism is engaged with the tape for conveying the tape and a second position where the tape conveying means is disengaged from the tape. A cover is pivotably supported on the housing for covering the tape printer. A coupling mechanism couples the cover to the printing mechanism and the tape conveying mechanism with the cover being displaceable between a first open position to actuate the coupling mechanism to move the printing mechanism and tape conveying mechanism to their respective second disengaged positions and a second closed position to actuate the coupling mechanism to move the printing mechanism and tape conveying mechanism to their respective first operative positions.

In a further embodiment, the tape cassette includes an opening for receiving a separate ribbon cassette. The ribbon cassette includes an opening through which the printing mechanism extends when the combined tape and ribbon cassettes are inserted in the printer.

In a further embodiment, opposing tape conveying rollers are provided in the tape cassette itself which permit the printer to print on tapes of varying widths.

Accordingly, it is an object of the present invention to provide an improved tape printer.

Another object of the present invention is to provide a tape printer which includes a pivotable cover which automatically disengages the print head and tape conveying mechanism from the tape when the cover is open.

A further object of the present invention is to provide a tape printer for use in conjunction with a tape cassette which includes a separate ribbon cassette insertable therein.

A still further object of the present invention is to provide a tape printer for use in conjunction with a tape cassette which includes opposing tape rollers for accepting tape of varying widths.

Still other objects and advantages of the invention will in part be obvious and wil' in part be apparent from the specification.

The invention accordingly comprises the features of construction, combination of elements, and arrangement of parts which will be exemplified in the constructions hereinafter set forth, and the scope of the invention will be indicated in the

BRIEF DESCRIPTION OF THE DRAWINGS

For a fuller understanding of the invention, reference is had to the following description taken in connection with the accompanying drawings, in which:

FIG. 1A is a left side elevational view of a tape printer constructed in accordance with a first embodiment of the present invention;

FIG. 1B is a top plan view of the tape printer of FIG. IA;

DETAILED DESCRIPTION OF THE PREFERRED EMBODIMENTS

Figure 1C:
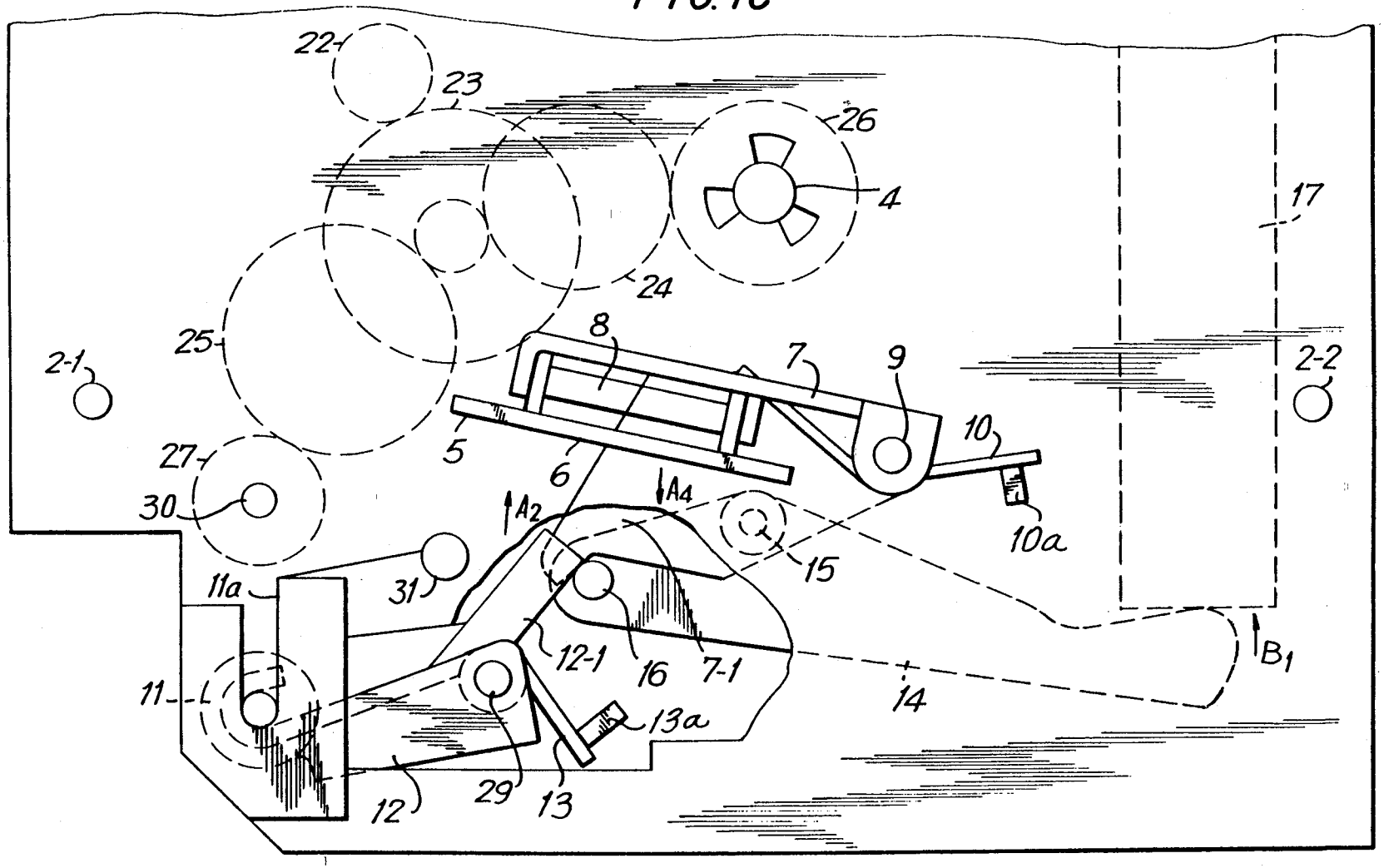
FIG. 1C is an enlarged fragmentary top plan view of the tape printer of FIG. 1B with the lever are rotated.

The several embodiments of the present invention will be explained with reference to the drawings. Reference is first made to FIGS. 1A and 1B which depict a tape printer, generally indicated at 50 and constructed in accordance with a first embodiment of the present invention.

Tape printer 50 includes a printer case 19 having a main frame 1 and a subframe 2. A thermal printing head 5 includes a plurality of equally spaced heating elements. Printing head 5 is supported on a head support 6. A head arm 7 which supports printing head 5 through a head supporting shaft 8 is rotatably supported on a head arm shaft 9 and includes a contact portion 7-1 which contacts a release lever shaft 16. A head pressing spring 10 urges head arm 7 in the direction of arrow $A_4$.

Also included in tape printer 50 is a tape-conveying roller 11 supported on a shaft portion 28-1 of a tape conveying gear 28, and a tape-conveying roller holder 12 which supports tape-conveying gear 28 and has a contact portion 12-1. A tape-conveying roller spring 13 urges shaft portion 28-1 in the direction of arrow $A_5$. A tape conveying roller holder shaft 29 supports tape-conveying roller holder 12.

A release lever 14 is supported on a release lever supporting shaft 15 which is coupled to main frame 1. Release lever 14 can rotate in the directions shown by arrow $A_6$. Release lever shaft 16 is coupled to release lever 14. Releasing lever 17 is guided by subframe 2 and can move in the directions shown by arrow $A_7$. Releasing lever 17 contacts release lever 14 and is displaced by a cover 20 which rotates on releasing cam shaft 21 and includes a releasing cam 18 which contacts releasing lever 17.

Also included is a motor 3 having a motor gear 22, a ribbon-winding gear 26 for rotating with motor gear 22 via a deceleration gear 23 and a transmission gear 24. A ribbon-winding shaft 4 includes a friction clutch which is driven by the ribbon-winding gear 26. A tape-conveying and transmitting gear 27 rotates with motor gear 22 via deceleration gear 23 and transmission gear 25. A tape-conveying and transmitting gear shaft 30 and platen roller shaft 31 are also included in the drive mechanism. Left and right position-determining shafts 2-1 and 2-2 are provided on subframe 2 to position the tape cassette when inserted.

In FIGS. 1A and 1B, releasing lever 17 is forced in the direction of arrow $A_0$ by releasing cam 18 when cover 20 is open. Releasing lever 17 is pressed in the direction of arrow $A_8$ by the force exerted by head-pressing spring 10 and tape-conveying roller spring 13. The force applied to releasing lever 17 in the direction $A_0$ by releasing cam 18 opposes the force applied to releasing lever 17 in the direction $A_8$ by head pressing spring 10 and tape conveying roller sprig 13. Releasing lever 17 presses against the flat end of releasing cam 18 in the direction $A_8$, forcing cover 20 to remain in an open position. Therefore, cover 20 remains open and does not rotate on shaft 21 until manually closed.

FIG. 1C discloses the operation of springs 10 and 13 to bias release lever 14 in an upward direction of arrow $B_1$ against releasing lever 17. When releasing lever 17 is pushed downward against release lever 14, release lever 14 pivots about shaft 15, thereby causing release lever shaft 16 to rotate in a direction opposite to arrow $A_4$. Shaft 16 bears against contact portion 7-1 and contact portion 12-1 thereby causing same to rotate in the direction opposite to $A_4$. Contact portions 7-1 and 12-1 are integrally connected with head arm 7 and tape-conveying roller holder 12, respectively, so that when lever shaft 16 contacts the contact portions, the head arm 7 and tape-conveying roller holder 12 move. Springs 10 and 13 are stopped by spring stops **10*a* and 13*a*, respectively, which prevent springs 10 and 13 from uncoiling. Accordingly, when shaft 16 is moved in the direction of $A_2$, contact portions 7-1 and 12-1 force springs 10 and 13 to coil. Therefore, springs 10 and 13 apply a force in the opposite direction ($A_4$). The end of release lever 14 which engages releasing lever 17 is thus forced thereagainst. This presses the upper end of releasing lever 17 (as viewed in FIGS. 1A and 1B) against a flat surface on releasing cam 18 to hold cover 20 in the open position and print head 5 and conveying roller 11 out of engagement with the cassette 52. FIG. 1C evidences the movement of print head 5 by depicting its rotation upward toward gear 23, and end conveying roller 11 is moved downward as shown by the change in its position within its resting groove 11***a*.

Figure 2B:
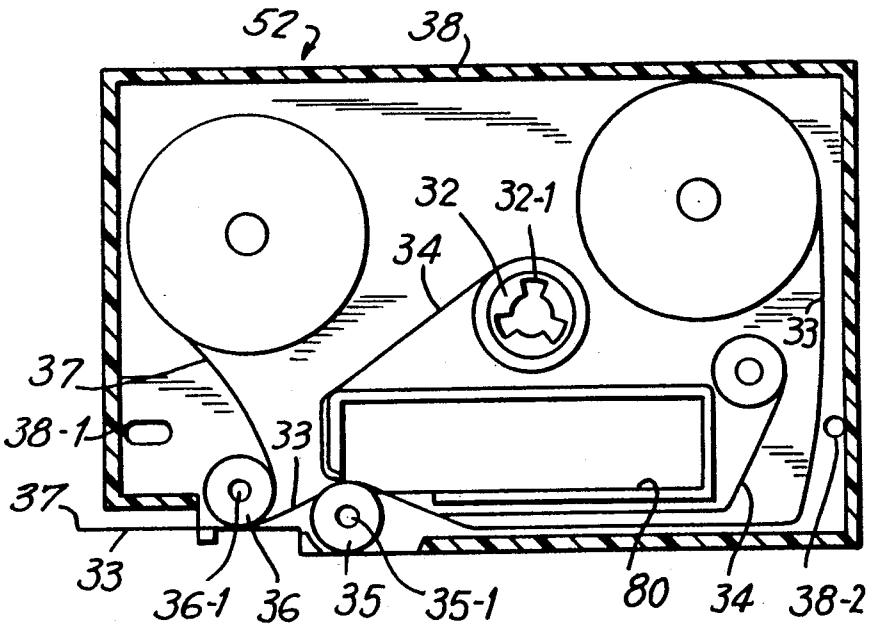
FIG. 2B is a top sectional view of the tape cassette of FIG. 2A.
Figure 2A:
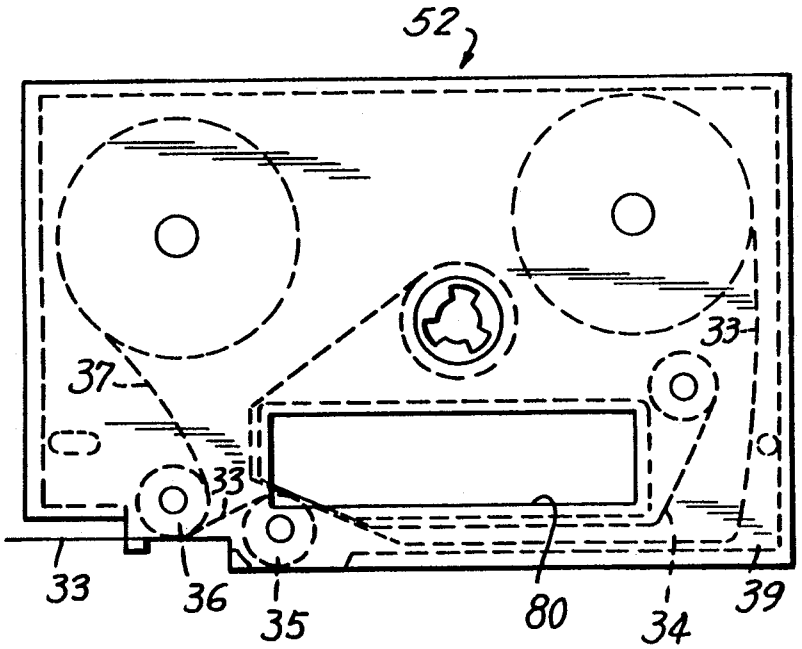
FIG. 2A is a top plan view of a tape cassette for use with the tape printer of FIGS. IA and IB.

Reference is now made to FIGS. 2A and 2B to explain the construction of a tape cassette, generally indicated at 52, for use in the printer of FIGS. 1A and 1B. Tape cassette 52 includes a lower case section 38 and an upper case section 39. A platen roller 35 includes an opening 35-1 and is supported on a platen roller shaft 31 in printer 50. A tape-pressing roller 36 includes an opening 36-1 which is supported by tape-conveying and transmitting gear shaft 30. Also included in cassette 52 is a thermal ink ribbon 34 and a ribbon-winding core 32 having a heteromorphic opening 32-1 which engages ribbon-winding shaft 4 and winds thermal ink ribbon 34. The printer prints on a transparent film 33 which then adheres to a double coated tape 37.

Lower cassette case section 38 includes position-determining openings 38-1 and 38-2 which engage position determining shafts 2-1 and 2-2 of the printer. Transparent film 33 adheres to double coated tape 37 at the position of tape-pressing roller 36. An opening 80 is provided in lower case section 38 to permit print head 5 to extend therein when the cassette is in the printer.

Figure 3B:
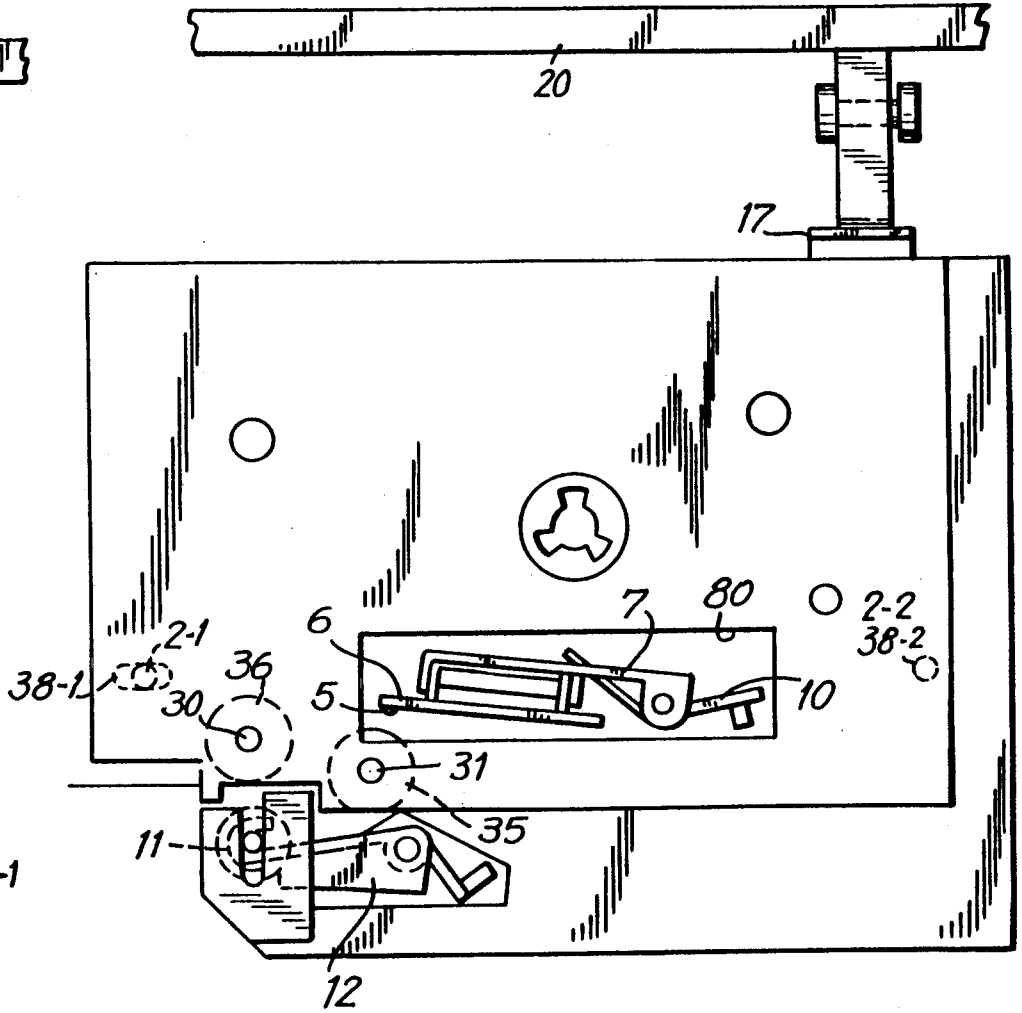
FIG. 3B is a top plan view of the tape printer of FIG. 3A.
Figure 3A:
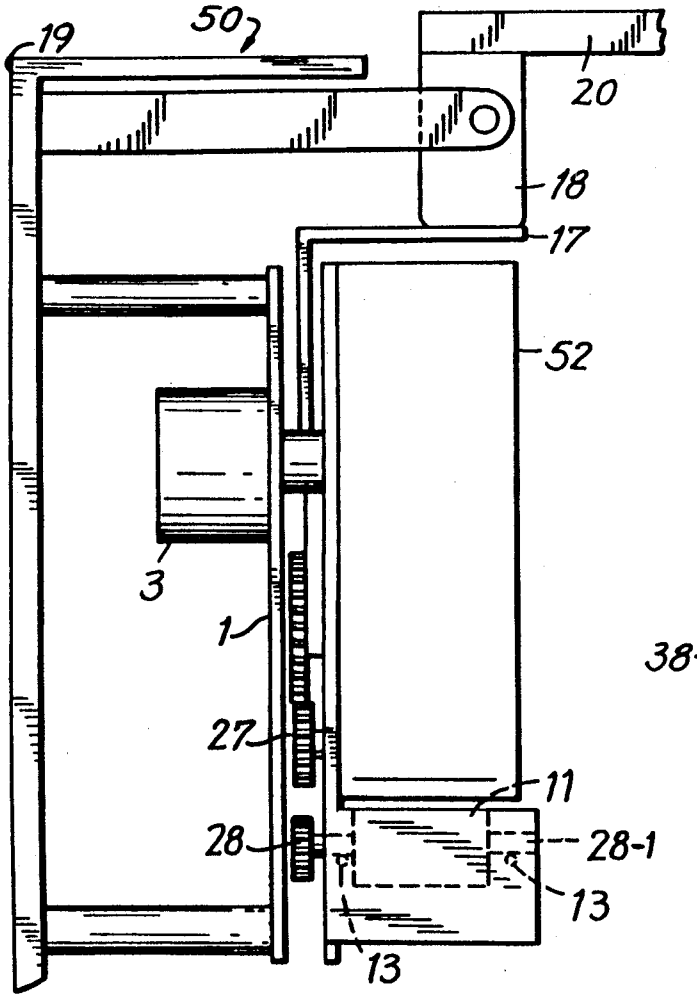
FIG. 3A is a left side elevational view of the tape printer of FIG. 1B with the cover open after insertion of the tape cassette.

Reference is now made additionally to FIGS. 3A and 3B to describe the manner in which tape cassette 52 is installed in tape printer 50, when cover 20 is open.

Openings 38-1 and 38-2 of lower cassette case section 38 engage respectively with position-determining shafts 2-1 and 2-2 provided on subframe 2 so that tape cassette 52 is properly positioned in tape printer 50. Platen roller 35 is supported by platen roller shaft 31 and tape-pressing roller 36 is supported by tape-conveying and transmitting gear shaft 30. Print head 5, head support 6 and associated components extend through opening 80 to position print head 5 proximate platen roller 35.

As seen in FIGS. 3A and 3B, installation of tape cassette 52 can be performed without any impediment from printing head 5 or tape-conveying roller 11 since, when cover 20 is open, printing head 5 and the tape conveying mechanism are disengaged from their operating positions.

Figure 4B:
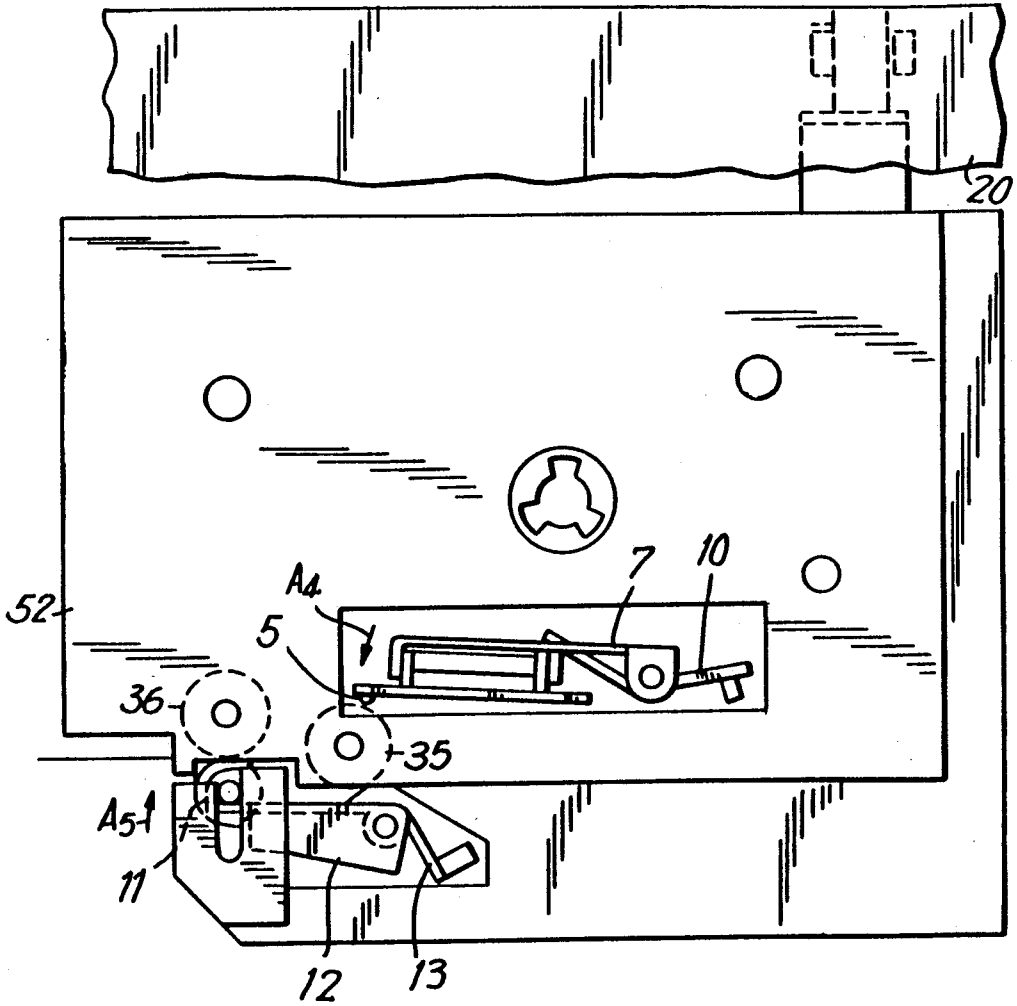
FIG. 4B is a top plan view of the tape printer of FIG. 4A.
Figure 4A:
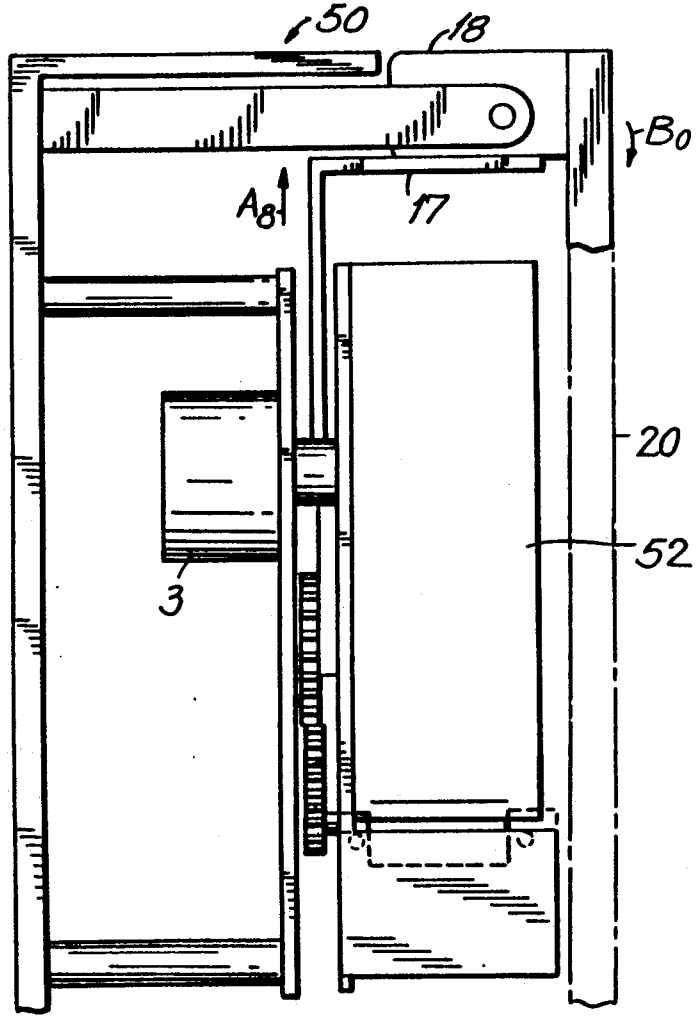
FIG. 4A is a left side elevational view of the tape printer of FIG. 3A shown with the cover closed.

FIGS. 4A and 4B show tape printer 50 in the operational mode with cover 20 closed. Rotation of cover 20 in the direction of arrow $B_0$ allows releasing lever 17 to move in the direction of arrow $A_8$ and releases head arm 7 and tape-conveying roller holder 12. This causes printing head 5, due to the force exerted by head-pressing spring 10 in the direction of arrow $A_4$, to press against platen roller 35. Tape-conveying roller 11 is forced to contact tape-pressing roller 36 due to the force exerted by tape conveying roller spring 13 in the direction of arrow $A_5$. In this condition, printing to tape 33 can occur.

When cover 20 is opened, printing head 5 and tape-conveying roller 11 are displaced to a position in which tape cassette 52 can be easily removed and replaced. When cover 20 is closed, printing head 5 and tape-conveying roller 11 are repositioned so that the printer is capable of printing.

Figure 5B:
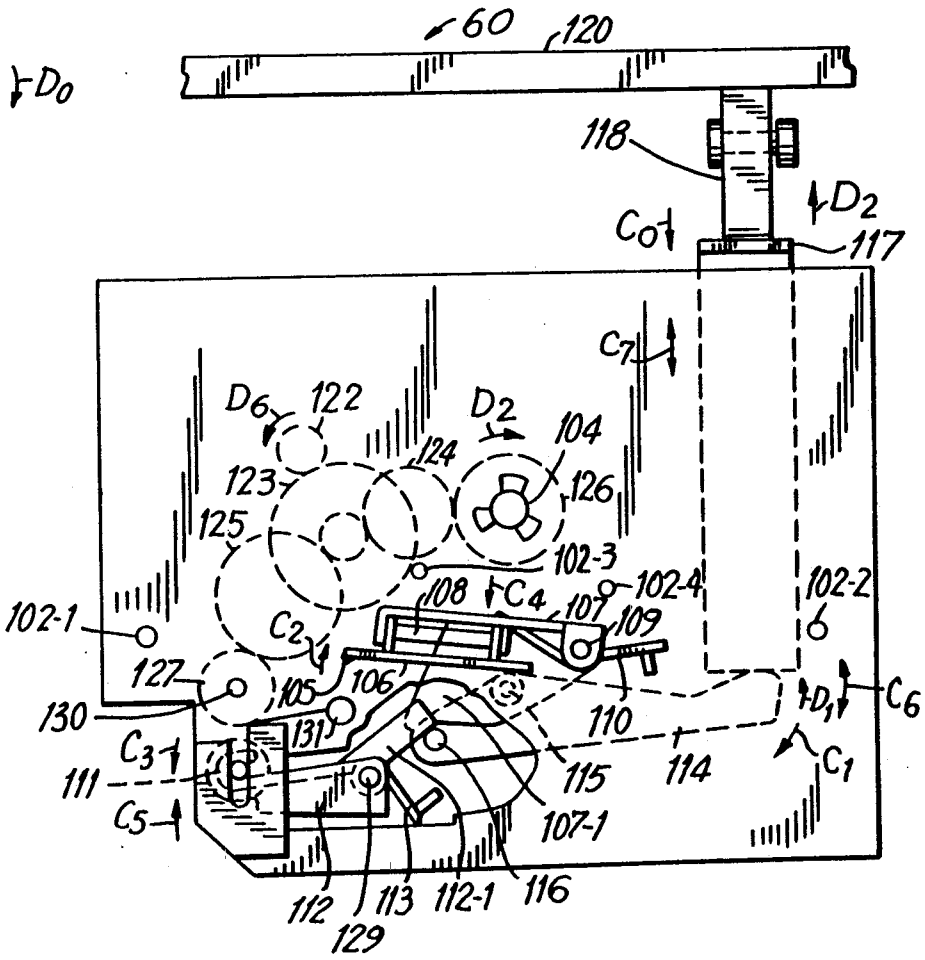
FIG. 5B is a top plan view of the tape printer of FIG. 5A.
Figure 5A:
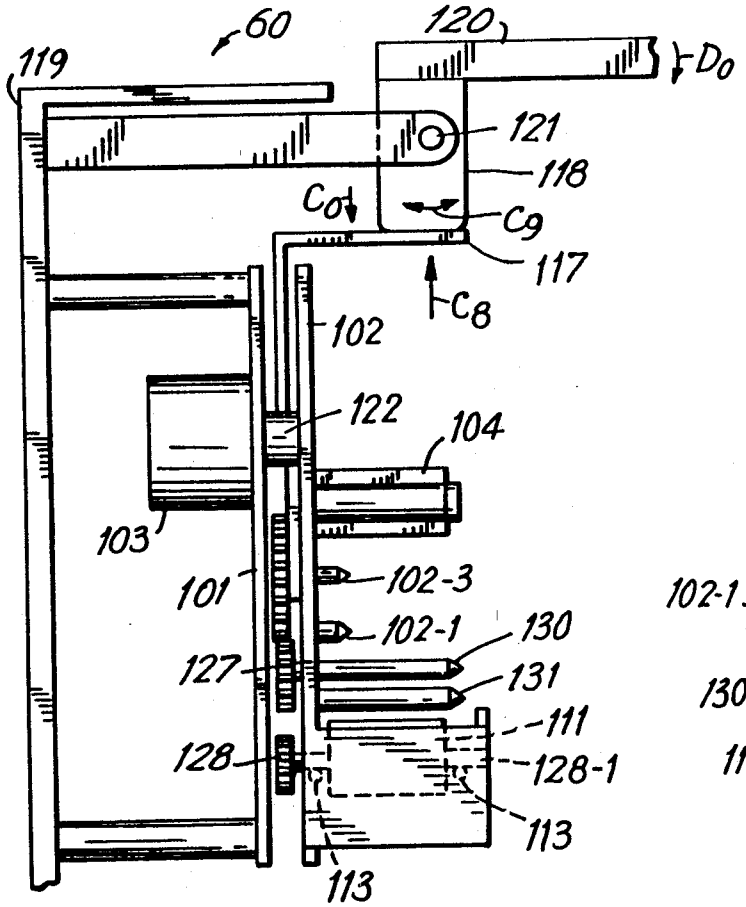
FIG. 5A is a left side elevational view of a tape printer constructed in accordance with a second embodiment of the present invention.

Reference is now made to FIGS. 5A and 5B which depict a tape printer generally indicated at 60, and constructed in accordance with a second embodiment of the present invention. The second embodiment is similar to the first embodiment but means are provided to permit use of a separate ribbon cassette.

Tape printer 60 includes a printer case 119 having a main frame 101 and a subframe 102. A thermal printing head 105 includes a plurality of equally spaced heating elements. Printing head 105 is supported on a head support 106. A head arm 107 which supports printing head 105 through a head supporting shaft 108 is rotatably supported on a head arm shaft 109 and includes a contact portion 107-1 which contacts a release lever shaft 116. A head pressing spring 110 urges head arm 107 in the direction of arrow $C_4$.

Also included in tape printer 60 is a tape-conveying roller 111 supported on a shaft portion 128-1 of a tape conveying gear 128, and a tape-conveying roller holder 112 which supports tape-conveying gear 128 and has a contact portion 112-1. A tape-conveying roller spring 113 urges shaft portion 128-1 in the direction of arrow $C_5$. A tape conveying roller holder shaft 129 supports tape-conveying roller holder 112.

A release lever 114 is supported on a release lever supporting shaft 115 which is coupled to main frame 101. Release lever 114 can rotate in the directions shown by arrow $C_6$. Release lever shaft 116 is coupled to release lever 114. Releasing lever 117 is guided by subframe 102 and can move in the directions shown by arrow $C_7$. Releasing lever 117 contacts release lever 114 and is displaced by a cover 120 which rotates on releasing cam shaft 121 and includes a releasing cam 118 which contacts releasing lever 117.

Also included is a motor 103 having a motor gear 122, a ribbon-winding gear 126 for rotating with the motor gear 122 via a deceleration gear 123 and a transmission gear 124. A ribbon-winding shaft 104 includes a friction clutch which is driven by the ribbon-winding gear 126. A tape-conveying and transmitting gear 127 rotates with motor gear 122 via deceleration gear 123 and transmission gear 125. A tape-conveying and transmitting gear shaft 130 and platen roller shaft 131 are also included in the drive mechanism. Left and right position-determining shafts 102-1 and 102-2 are provided on subframe 102 to position the tape cassette when inserted. Left and right ribbon cassette position-determining shafts 102-3 and 102-4 are provided to position a separate ribbon cassette as explained in detail below.

In FIGS. 5A and 5B, releasing lever 117 is forced in the direction of arrow $C_0$ by releasing cam 118 when cover 120 is open. Releasing lever 117 is pressed in the direction of arrow $C_8$ by the force exerted by head-pressing spring 110 and tape-conveying roller spring 113. Therefore, cover 120 remains open and does not rotate on shaft 121 until manually closed.

Figure 6A:
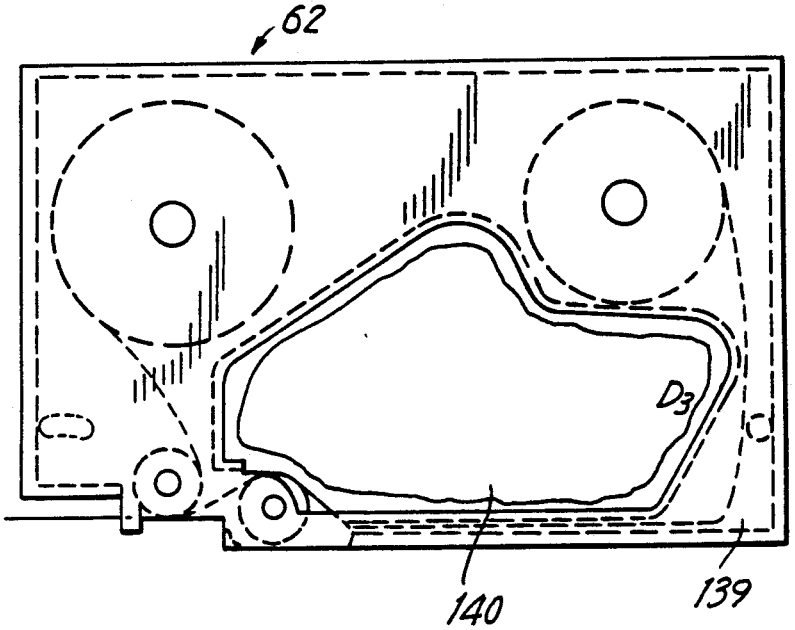
FIG. 6A is a top plan view of a tape cassette constructed for use in the tape printer of FIG. 5B.
Figure 6B:
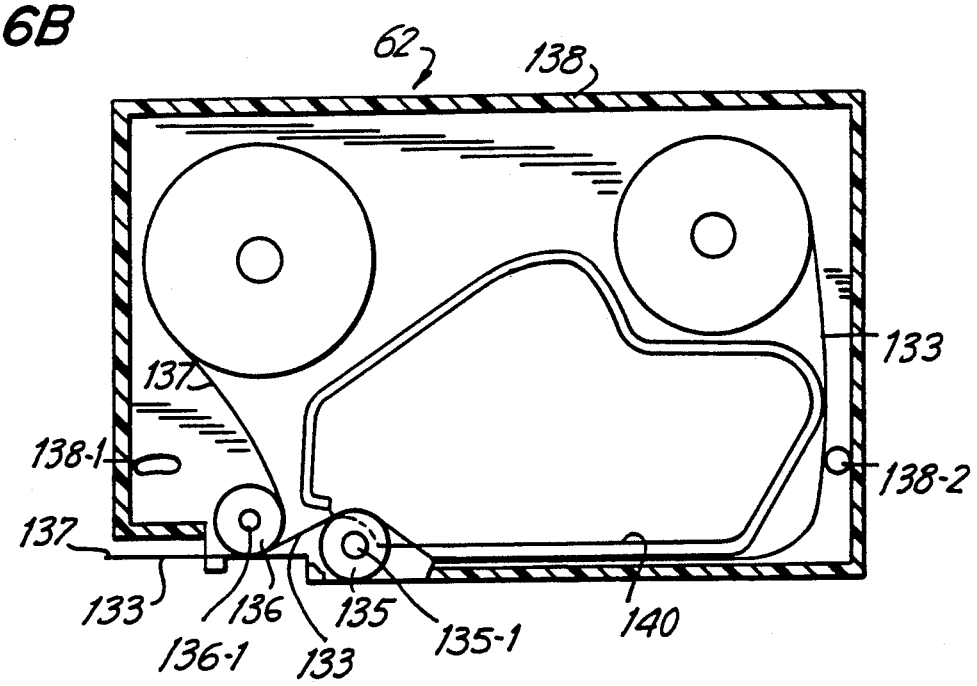
FIG. 6B is a top cross sectional view showing the interior of the tape cassette of FIG. 6A.

Reference is now made to FIGS. 6A and 6B which depict a tape cassette, generally indicated at 62, for use in printer 60. Cassette 62 includes an upper case section 139 and a lower case section 138. A platen roller 135 having an opening 135-1 is supported by platen roller shaft 131 upon insertion of tape cassette 62 into tape printer 60. A tape-pressing roller 136 includes an opening 136-1 which is supported by tape-conveying and transmitting gear shaft 130 when in the printer. Transparent tape 133 adheres to a double coated tape 137 at tape pressing roller 136. In addition, an enlarged opening 140 located toward the middle portion of tape cassette 62 is provided in order to allow for insertion of a separate ribbon cassette 64 (FIG. 7A).

Lower case section 138 includes position determining openings 138-1 and 138-2 for engaging shafts 102-1 and 102-2 respectively in printer 60.

Figure 7C:
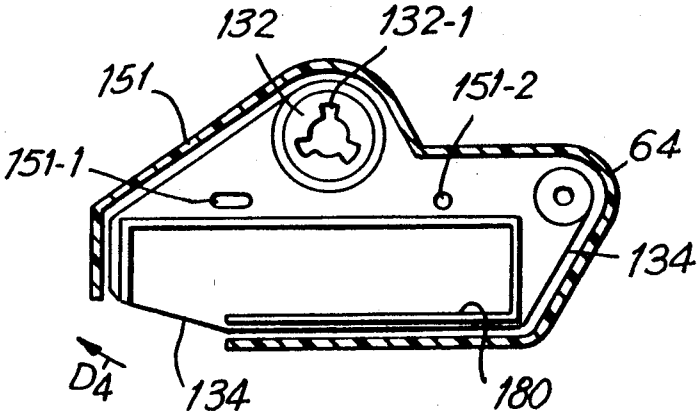
FIG. 7C is a top sectional view of the ribbon cassette of FIG. 7B.
Figure 7B:
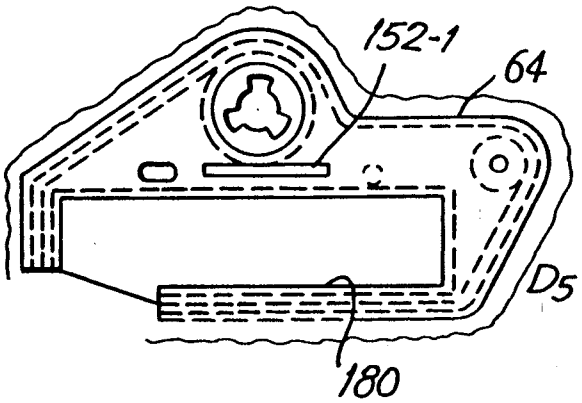
FIG. 7B is a top plan view of the ribbon cassette of FIG. 7A.
Figure 7A:
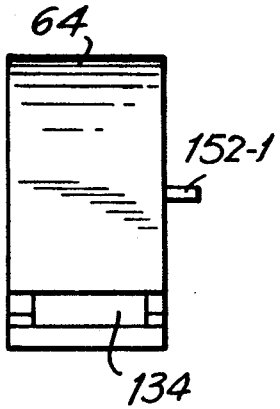
FIG. 7A is a left side elevational view of a ribbon cassette for use in the tape printer of FIG. 5B.

Referring now additionally to FIGS. 7A, 7B and 7C, ribbon cassette 64 is depicted and includes a thermal ink ribbon 134 and a ribbon-winding core 132 having a heteromorphic opening 132-1 which engages ribbon-winding shaft 104 in printer 60 and winds thermal ink ribbon 134. Ribbon cassette 64 has a lower case section 151 having position-determining openings 151-1 and 151-2 for engaging position-determining shafts 102-3 and 102-4, respectively, of tape printer 60, and an upper case section 152 provided with a knob 152-1. The external shape $D_5$ of ribbon cassette 64 is sized and shaped to permit insertion into enlarged opening 140 ($D_3$) of tape cassette 62. Ribbon cassette 64 includes an opening 180 in lower case section 151 to permit print head 105 to extend therein when the cassette is in the printer.

Figure 8A:
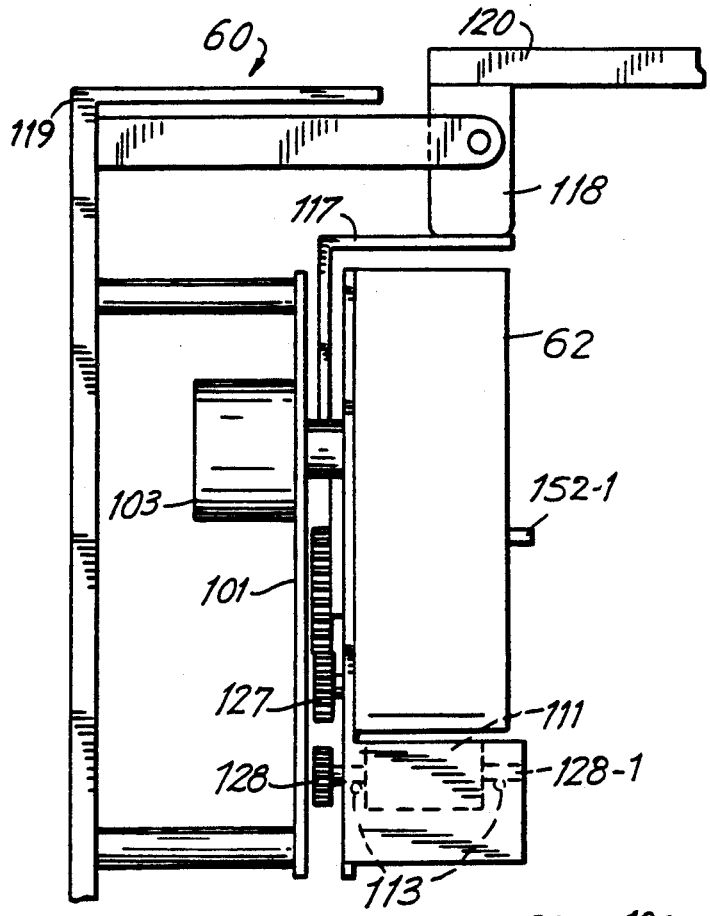
FIG. 8A is a left side elevational view of the tape printer of FIG. 5A with the cover open and with the ribbon and tape cassettes installed.
Figure 8B:
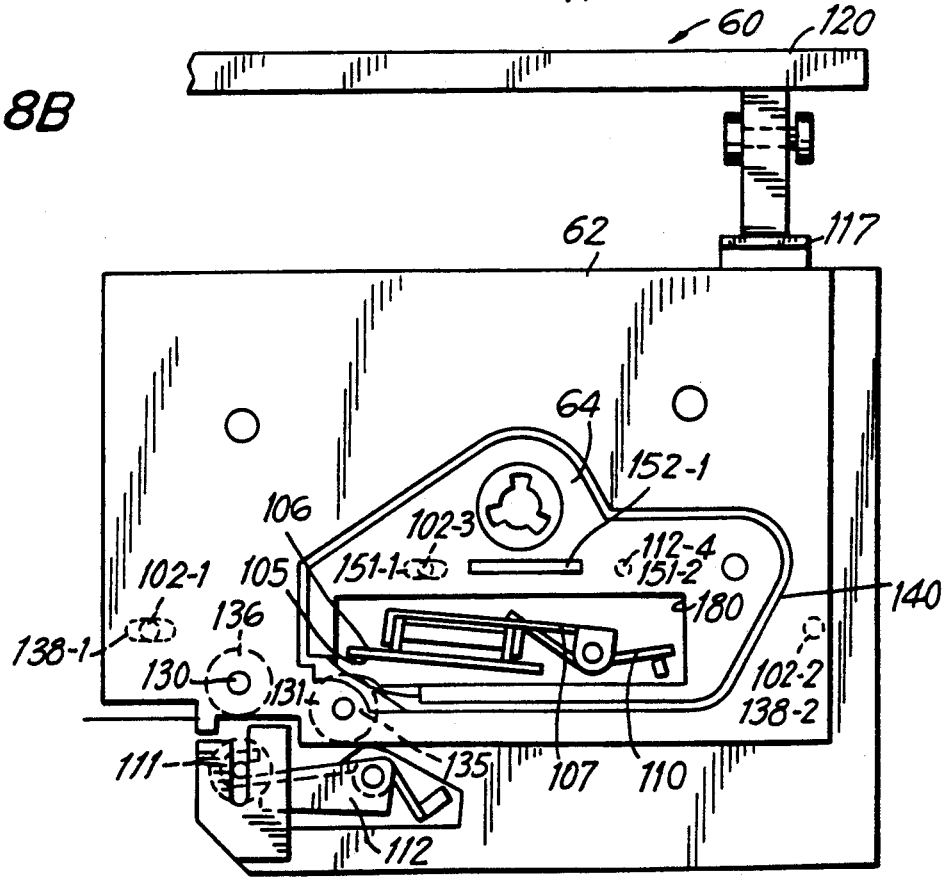
FIG. 8B is a top plan view of the tape printer of FIG. 8A.

Referring now to FIGS. 8A and 8B, the insertion of tape cassette 62 and ribbon cassette 64 into printer 60 will be explained. Position-determining openings 138-1 and 138-2 of lower cassette case 138 engage with position-determining shafts 102-1 and 102-2, respectively, of printer 60 provided on subframe 102. This properly positions tape cassette 62 in tape printer 60. In addition, position-determining openings 151-1 and 151-2 of lower ribbon case 151 engage with position determining shafts 102-3 and 102-4, respectively, of tape printer 60 provided on subframe 102, so that ribbon cassette 64 is engaged at the proper position. A slight gap is provided between tape cassette 62 and ribbon cassette 64. Platen roller 135 is supported by platen roller shaft 131, and tape-pressing roller 136 is supported by tape-conveying and transmitting gear shaft 130. The print head components including print head 105 extend through opening 140 in ribbon cassette 64 to allow printing on tape 133.

When cover 120 is open, print head 105 and tape conveying roller 111 are moved out of their operative positions. Accordingly, installation of tape cassette 62 and ribbon cassette 64 in printer 60 can be performed without any interference.

Figure 9B:
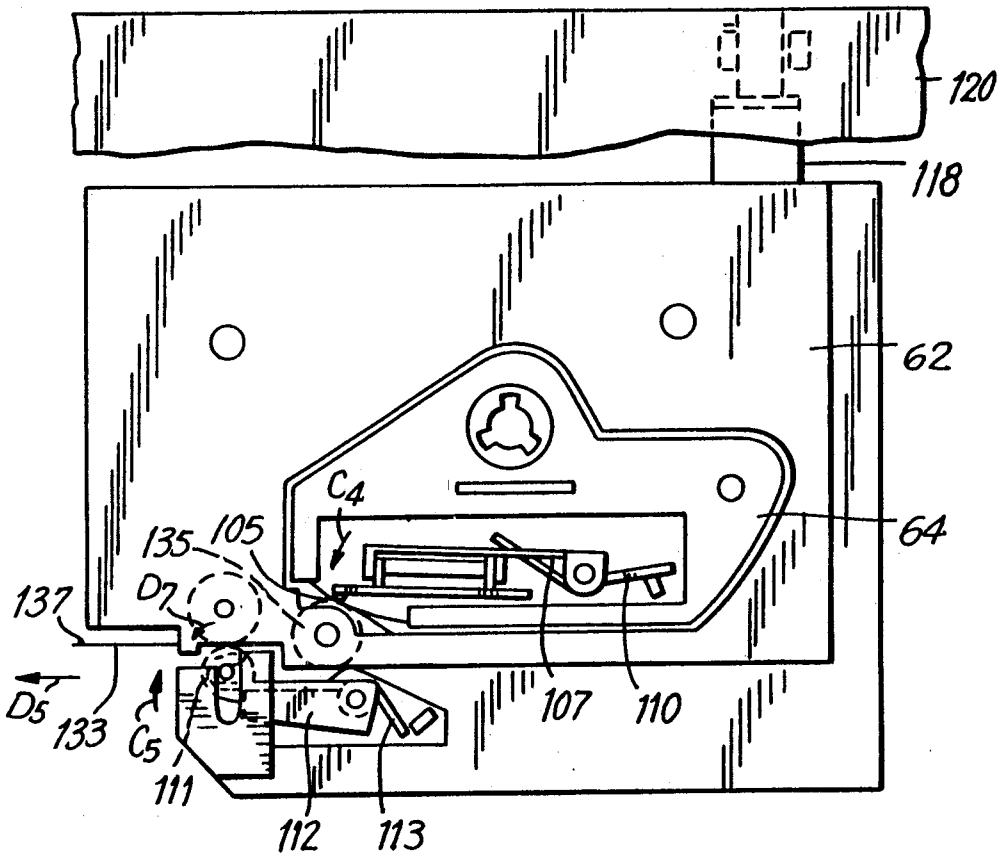
FIG. 9B is a top plan view of the tape printer of FIG. 9A.
Figure 9A:
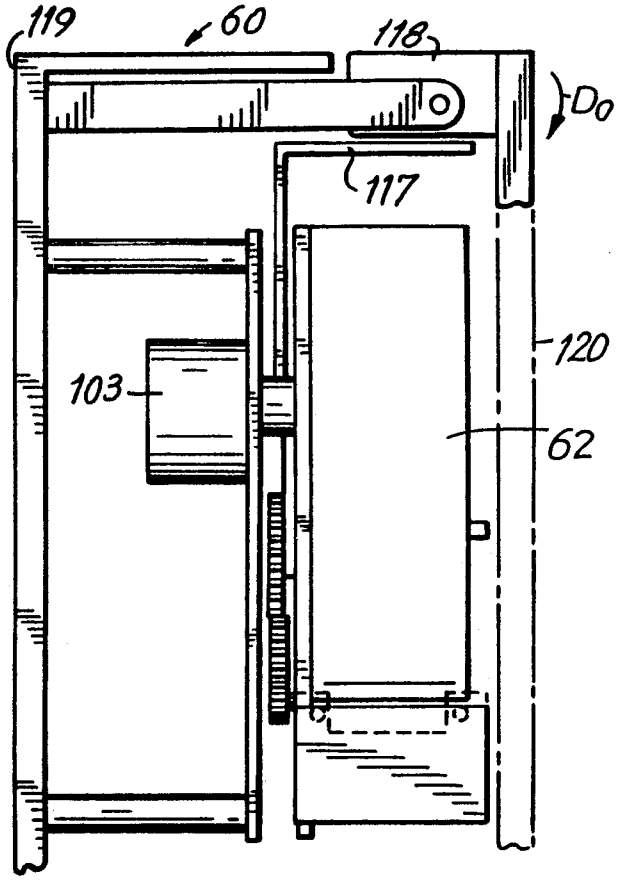
FIG. 9A is a left side elevational view of the tape printer of FIG. 8A shown with the cover closed.

FIGS. 9A and 9B depict the tape printer 60 in the operative state with cover 120 closed. Rotation of cover 120 in the direction of the arrow $D_0$ releases head arm 107 and tape-conveying roller holder 112 so that printing head 105 is forced to contact platen roller 135 by the action of head-pressing spring 110 in the direction of arrow $C_4$. Tape-conveying roller 111 is moved in the direction of arrow $C_3$ to contact with tape-pressing roller 136 due to the force exerted by tape-conveying roller spring 113.

Rotation of motor gear 122 in the direction of arrow $D_6$ (FIG. 5B) allows ribbon-winding gear 126 to rotate in the direction of arrow $D_2$ (FIG. 5B). This allows tape-conveying gear 128 to rotate in the direction of arrow $D_7$. Rotation of tape-conveying gear 128 in the direction of arrow $D_7$ permits tape-conveying roller 111 to rotate in the direction of arrow $D_7$, so that transparent film 133 which adheres to double coated tape 137 is conveyed in the direction of arrow $D_5$.

Along with travel of transparent film 133, thermal ink ribbon 134 is conveyed in the direction of arrow $D_4$, and any slack generated therein is subjected to winding by ribbon-winding core 132 driven by ribbon-winding shaft 104. Printing head 105 transcribes ink 134-1 from thermal ink ribbon 134 onto transparent tape 133 while transparent tape 133 is conveyed through tape printer 60.

Figure 10B:
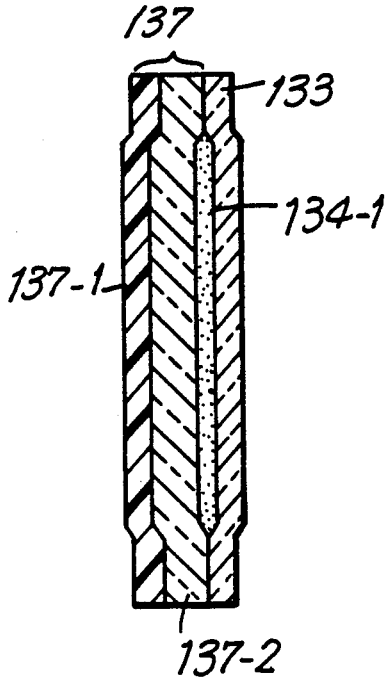
FIG. 10B is sectional view taken along line 10B—10B of FIG. 10A.
Figure 10A:
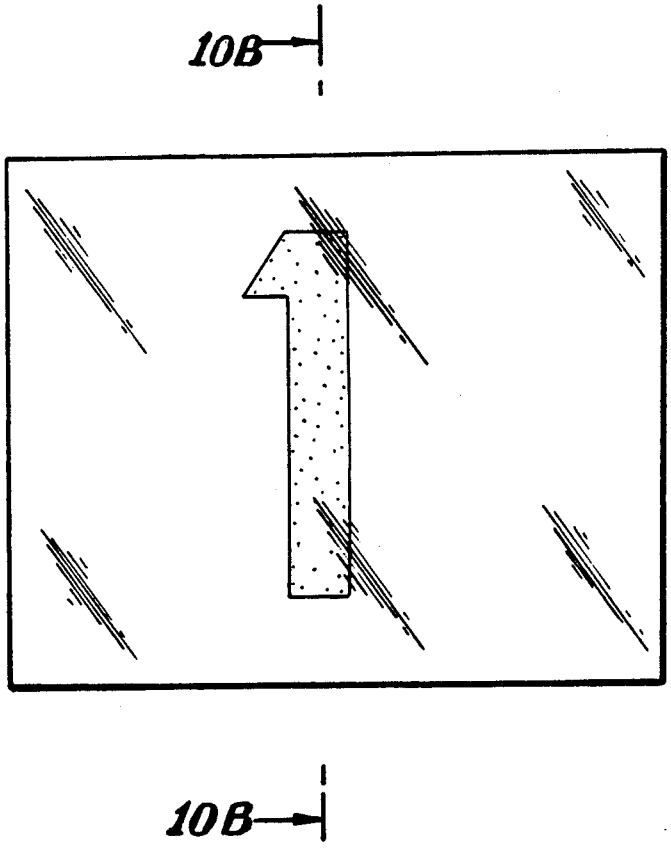
FIG. 10A is a top plan view of a printed sample of tape.

FIGS. 10A and 10B show a printed sample in which the numeral "1" is printed by the tape printer onto transparent tape 133. In the printed sample of FIGS. 10A and 10B, black ink 134-1 is transcribed onto transparent tape 133, and the front surface 137-2 of double-sided adhesive tape 132 ban be white and is affixed to the back of transparent tape 133. Changing the color of ink 134-1 and self-adhesive tape 137-2 makes it possible to obtain colorful printings without any difficulty.

It is noted that a removable film 137-1 can be provided on double-sided adhesive tape 137.

In order to obtain different colorful printings, tape printer 60 according to the second embodiment of the present invention is provided with several tape cassettes corresponding to several colors of self-adhesives, and several ribbon cassettes corresponding to multiple colors of ink.

The tape printer constructed as described above requires replacement of the tape cassette or the ribbon cassette in order to obtain colorful printings, which can be carried out by independently replacing the tape cassette or the ribbon cassette, respectively.

Figure 11B:
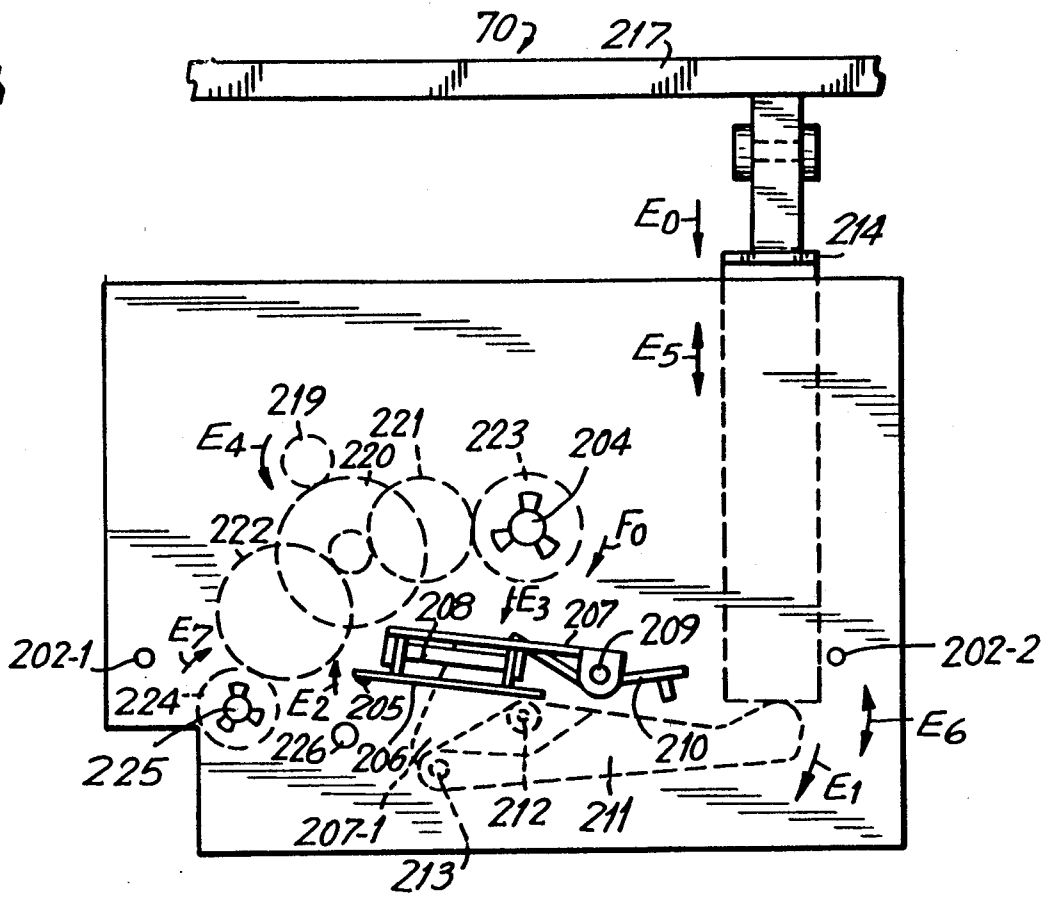
FIG. 11B is a top plan view of the tape printer of FIG. 11A.
Figure 11A:
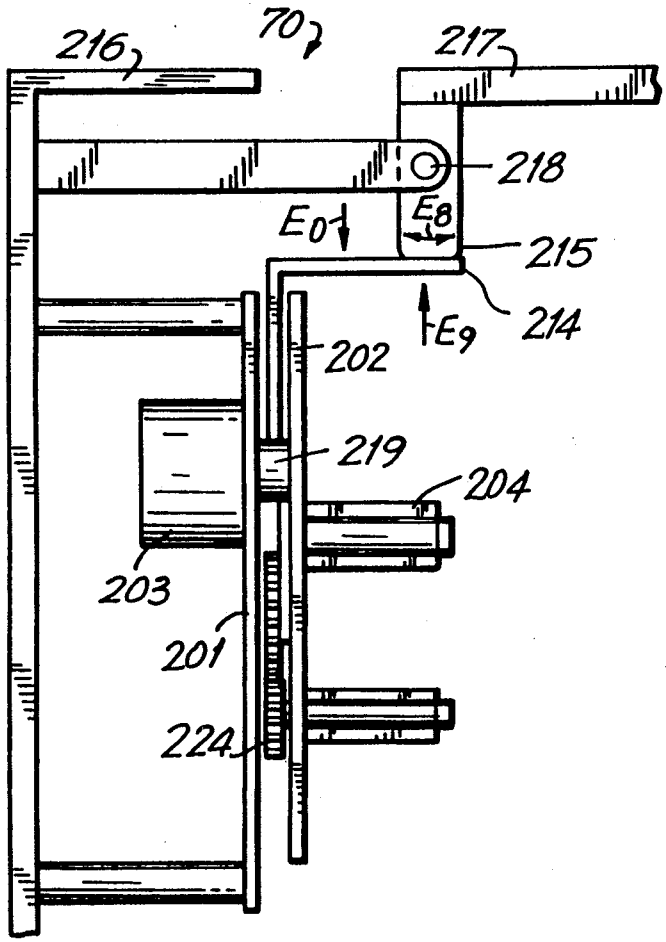
FIG. 11A is a left side elevational view of a tape printer constructed in accordance with a third embodiment of the present invention.
Figure 12A:
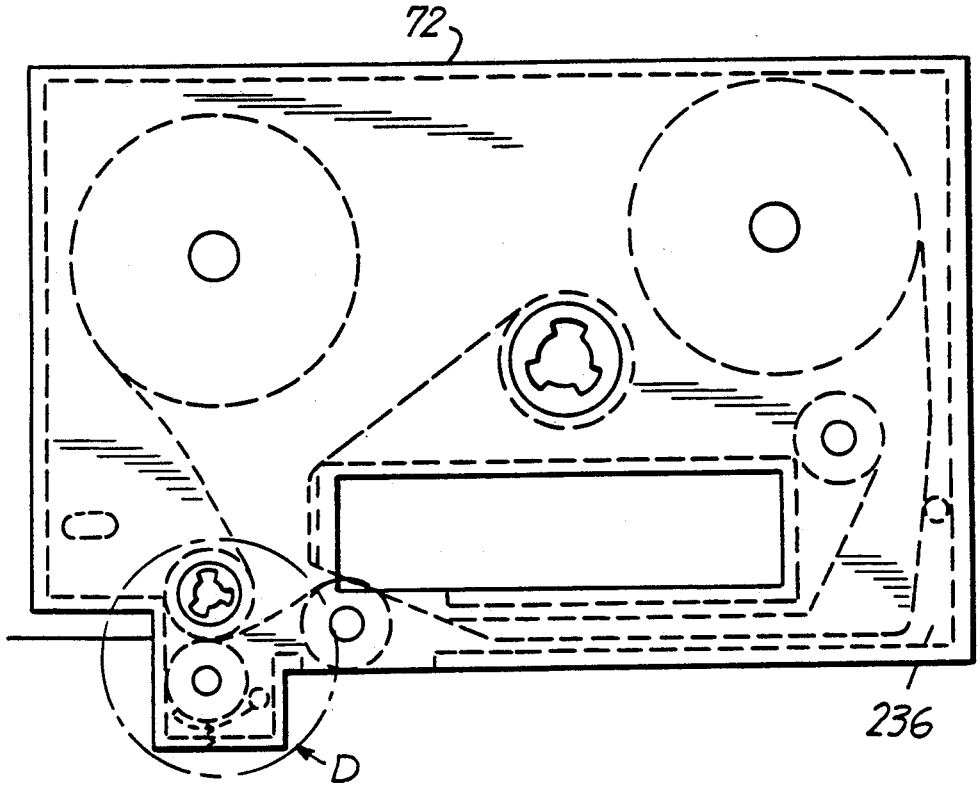
FIG. 12A is a top plan view of a tape cassette for use with the tape printer of FIG. 11B.
Figure 12B:
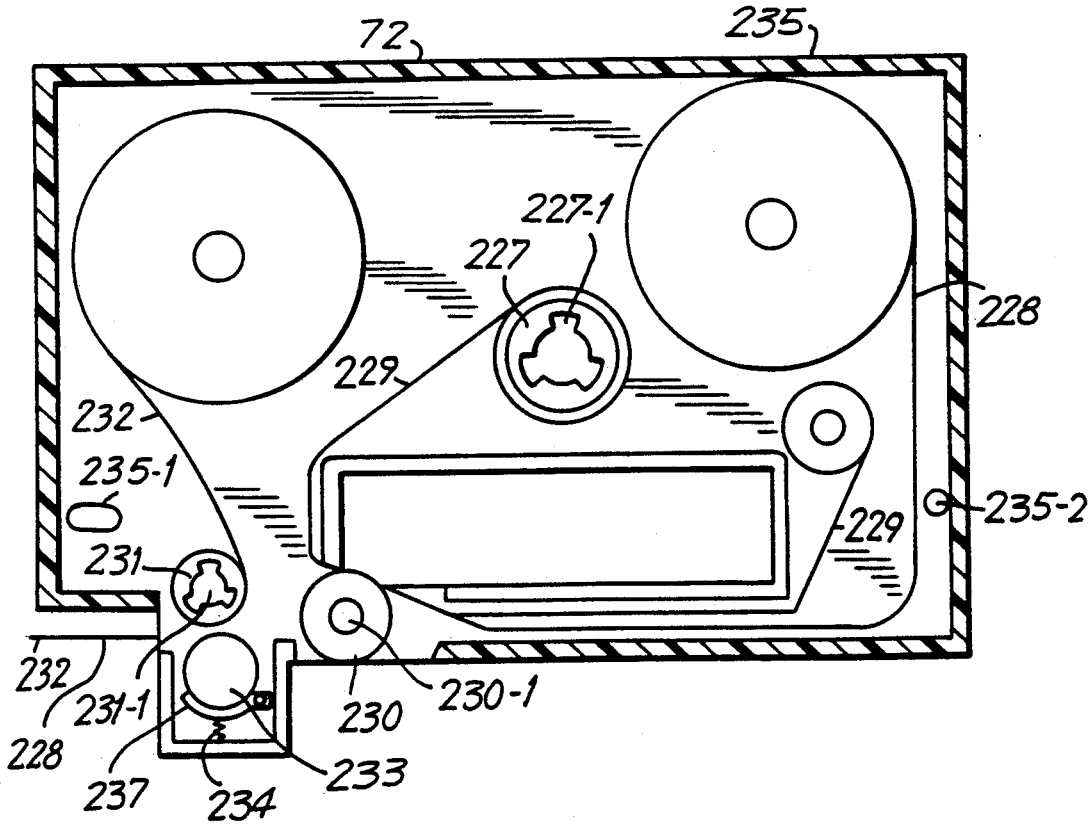
FIG. 12B is a top sectional view of the tape cassette of FIG. 12A.
Figure 13B:
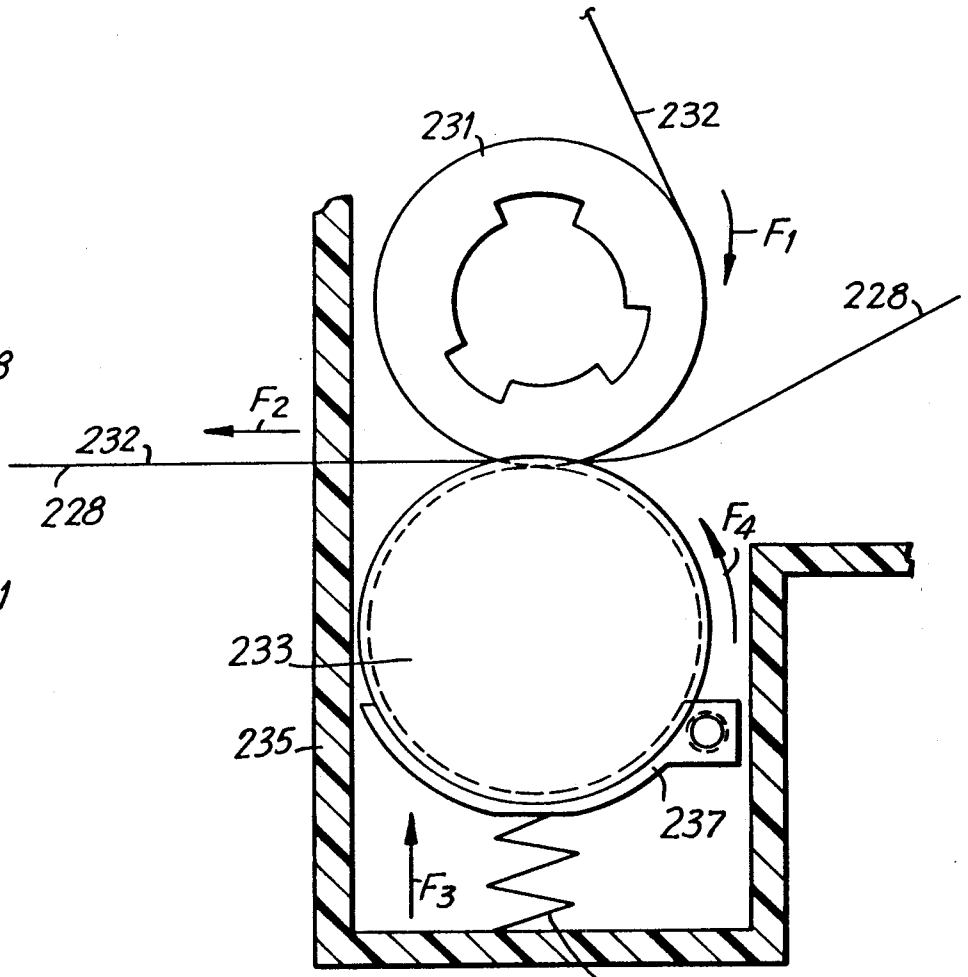
FIG. 13B is a top sectional view of the tape conveying portion of FIG. 12A.
Figure 13A:
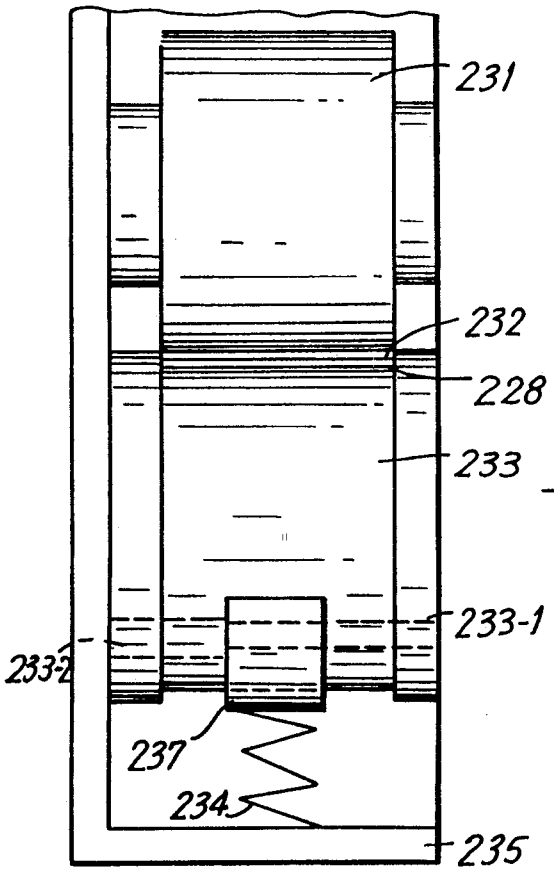
FIG. 13A is a left side elevational view showing the tape conveying portion of the tape cassette of FIG. 12A.

The third embodiment of the present invention will be explained with reference to FIGS. 11A and 11B. Cover 217 is shown open on printer 70. Thermal head 205 includes a plurality of heating elements spaced equally and supported on a head support 206. Head arm 207 is supported by head arm shaft 209 and includes a contact portion 207-1 which contacts release lever shaft 213. Head-supporting shaft 208 supports head support 206 by a shaft on head arm 207. Head-pressing spring 210 activates head arm 207 in the direction of $E_3$. Release lever 211 supported by release lever supporting shaft 212 is fixed on main frame 201 and is capable of rotating in the directions of arrow $E_6$. Release lever shaft 213 is coupled to release lever 211. Releasing lever 214 is guided by a subframe 202 and moves in the directions of arrow $E_5$ and contacts release lever 211.

Cover 217 rotatably supported on shaft 218 includes a releasing cam 215 which controls movement of releasing lever 214. Main frame 201 is supported on printer case 216. Release lever 211 rotates in the direction of $E_1$ when the releasing lever 214 applies force against it. Releasing lever 214 is guided along main frame 201 by subframe 202. Lever 214 is displaceable by cover 217.

Also included is a motor 203 having a motor gear 219, a ribbon-winding gear 226 for receiving rotation of motor gear 219 via a deceleration gear 220 and a transmission gear 221. A ribbon-winding shaft 204 having the structure of a friction clutch is coupled to main frame 201 and is driven by a ribbon-winding gear 223.

The tape conveying mechanism includes a tape conveying and transmitting gear 224 which is rotated by motor gear 219 via deceleration gear 220 and transmission gear 222 Also included is a tape conveying and transmitting gear shaft 225 coupled to gear 224 and a platen roller shaft 226. Position determining shafts 202-1 and 202-2 are mounted to subframe 202.

When cover 217 is open, releasing lever 214 is forced in the direction of arrow $E_0$ by releasing cam 215. This forces head support 206 to rotate in the direction of arrow $E_2$. Releasing cam 215 is pressed in the direction of $E_9$ by the action of head pressing spring 210.

Referring now to FIGS. 12A, 12B, 13A and 13B, tape cassette 72 for use in the third embodiment of printer 70 will be described. Cassette 72 includes a platen roller 230 having an opening 231-1 supported by platen roller shaft 226 in printer 70 and a tape conveying roller 231 having a heteromorphic opening 231-1 for engaging transmitting gear shaft 225 in printer 70. Also present in the cassette is ribbon winding core 227 having a heteromorphic opening 227-1 for engaging ribbon-winding shaft 204. Ribbon-winding core 227 winds thermal ink ribbon 229. Transparent film 228 and double coated adhesive tape 232 ar coupled during transmission between the conveying roller 231 and a tape pressing roller 233. Tape pressing roller 233 is urged in the direction of arrow $F_3$ by tape-pressing roller spring 234.

Separator 237 supports tape pressing roller 233 and in concert with tape pressing roller spring 234 presses tape pressing roller 233 against tape conveying roller 231. Tape pressing roller 233 has collars 233-1 and 233-2 for guiding transparent film 228 and double coated film 232.

Lower cassette case 235 includes position-determining openings 235-1 and 235-2 which engage position-determining shafts 202-1 and 202-2 on printer 70. Cassette 72 also includes an upper case section 236.

Figure 14B:
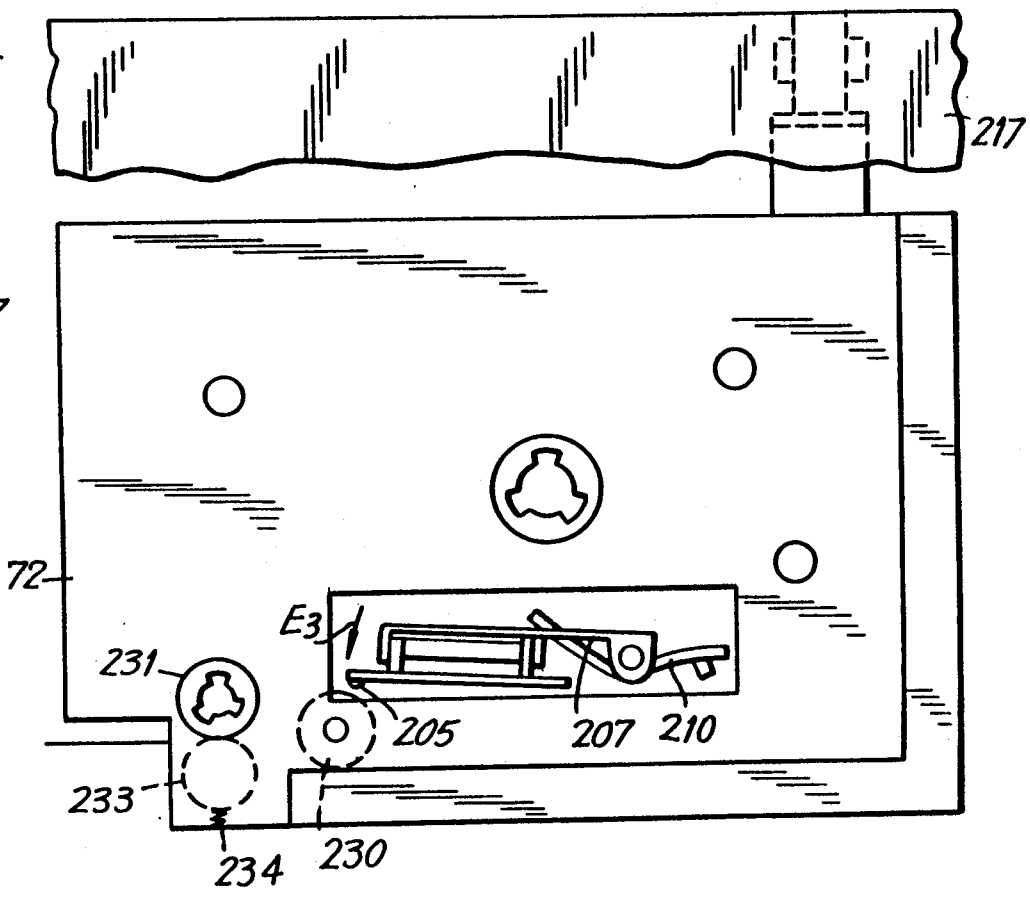
FIG. 14B is a top plan view of the tape printer of FIG. 14A.
Figure 14A:
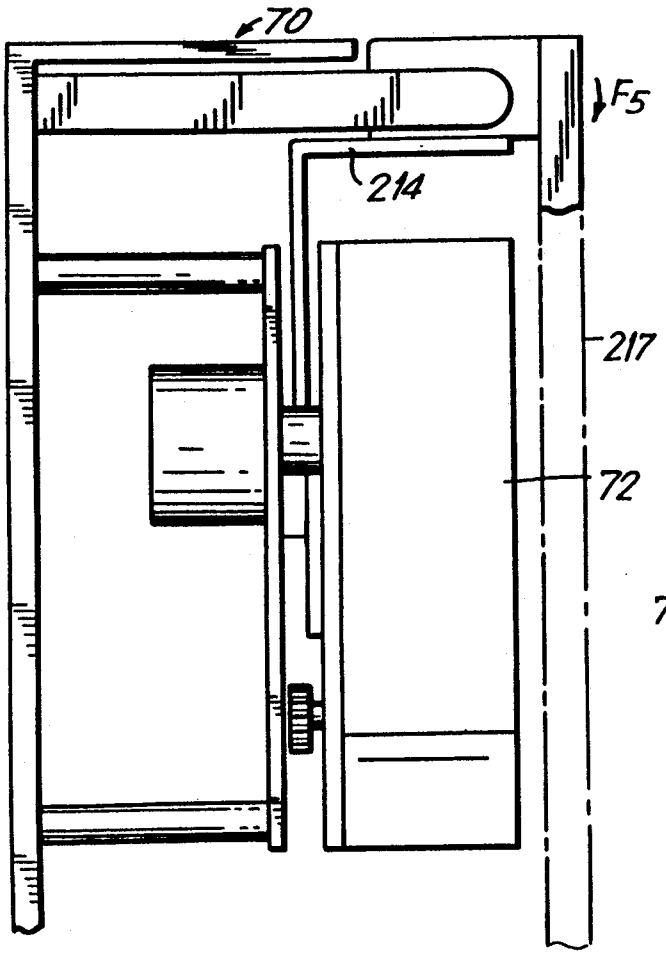
FIG. 14A is a left side elevational view of the tape printer of FIG. 11A shown with the cover closed.

FIGS. 14A and 14B show the operative position of the tape printer with cover 217 closed wherein printing head 205 contacts platen roller 226 due to the force exerted by head pressing spring 210.

Figure 15:
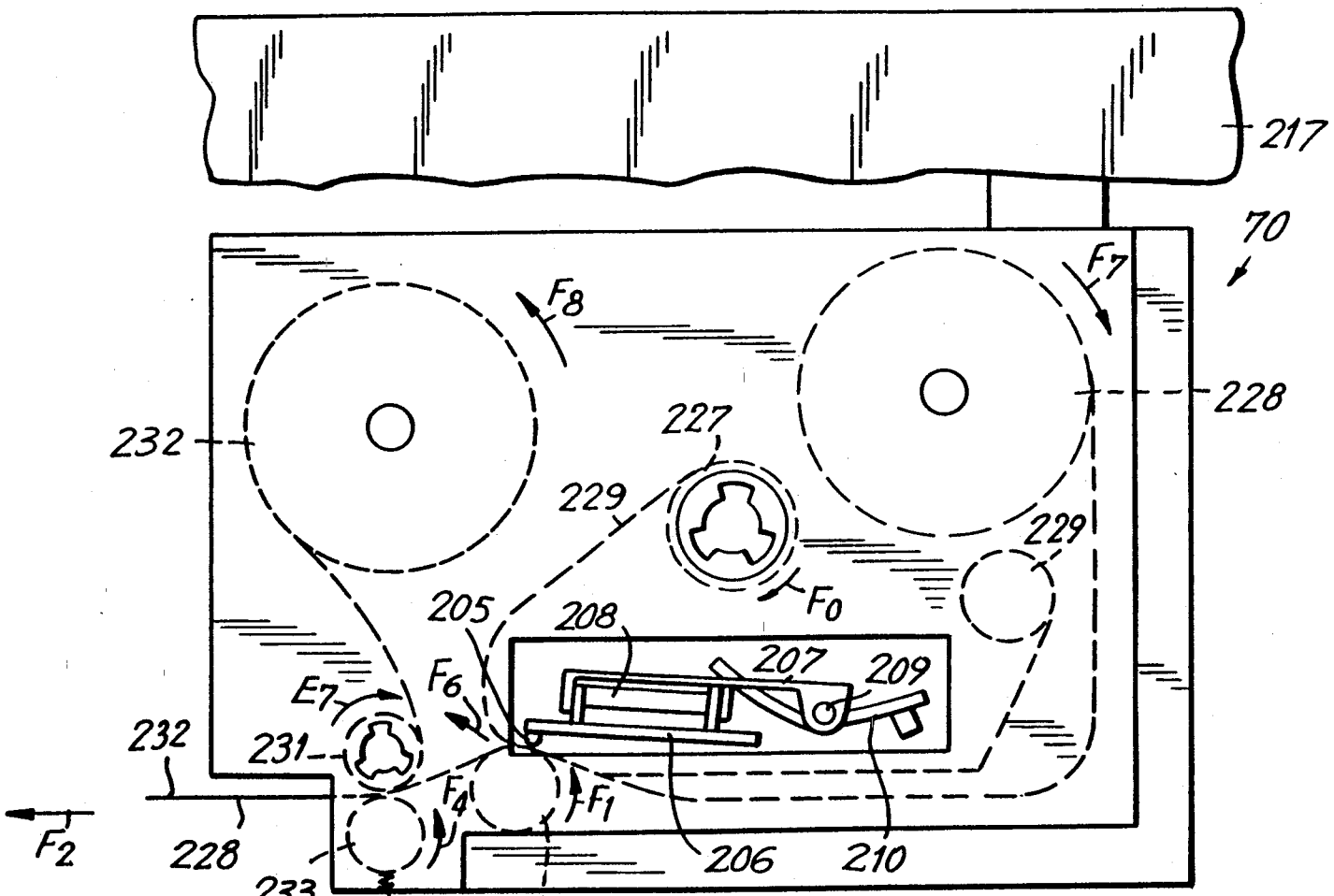
FIG. 15 is a top plan view of the tape printer of FIG. 14A shown with the tape cassette inserted in the printer.

FIG. 15 shows tape printer 70 of the third embodiment in its operative state printing on transparent film 228.

The operation of the third embodiment will now be explained. Rotation of motor gear 219 in the direction of arrow $E_4$ allows ribbon-winding gear 223 to rotate in the direction of arrow $F_0$ and allows tape-conveying and transmitting gear 224 to rotate in the direction of arrow $E_7$. This permits tape-conveying roller 231 to rotate in the direction of arrow $E_7$ so that transparent film 228 which is adhered to double coated tape 232 is conveyed in the direction of arrow $F_2$. Thermal ink ribbon 229 is conveyed in the direction of arrow $F_6$ and any slack generated therein is wound by ribbon-winding core 227 which is rotated by ribbon-winding shaft 204 in the direction of arrow $F_0$. Printing is performed according to the distance of travel of transparent film 228.

Since tape-conveying roller 231 and the tape-pressing roller 233 are provided within the tape cassette, even when the tape width is altered, a tape-conveying means suitable for such tape width can be provided directly in the tape cassette. Accordingly, tapes of varying widths can be used in the same printer.

As described above, the tape printer according to the present invention is designed so that when the lid is opened, the printing head and tape-conveying roller are moved automatically out of their operative positions. Therefore, during replacement of the tape cassette, a separate operation for releasing the printing head and tape-conveying roller becomes unnecessary so that it becomes possible to perform replacement of the tape cassette only by opening the cover and removing the tape cassette. In addition, possible destruction of parts during removing of the tape cassette is substantially decreased.

The tape printer according to the present invention also has such a construction that the external shape of the ribbon cassette is smaller than the receiving opening in the tape cassette so that the tape cassette and the ribbon cassette can be independently replaced. Therefore, changing of the color of the self-adhesive tape and the color of the printed letters can be performed with ease. This prevents problems from occurring and increases efficiency.

Moreover, the tape printer according to the present invention provides a tape-conveying means suitable for different tape widths even when the tape width is altered. Therefore, conveying of a tape with constant stability becomes possible, and it has become possible to accept different tape widths in a single printer.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A tape printer for printing on a tape comprising a housing, printing means for selectively printing on said tape, displacing means supporting said printing means on said housing for displacement between a first position where said printing means is adjacent said tape for printing thereon and a second position where said printing means is disengaged from said tape, tape conveying means for conveying said tape across said printing means, said displacing means supporting said tape conveying means on said housing for displacement between a first position where said tape conveying means is engaged with said tape for conveying said tape and a second position where said tape conveying means is disengaged from said tape, over means pivotably supported on said housing for covering said tape printer and pivotable between a first open position and a second closed position, said displacing means being operatively coupled to said cover means for the displacement of said displacing means between said first and second positions of said printing means and tape conveying means in response to the pivoting of said cover means between said closed and open positions, whereby said cover means moves said printing means and said tape conveying means to their respective second disengaged positions when open and moves said printing means and said tape conveying means to their respective first engaged positions when closed.

2. The tape printer as claimed in claim 1, wherein said displacing means includes cam means supported on said cover means and lever means slidably disposed on said housing and contacting said cam means, said lever means having a first portion for contacting said printing means and a second portion for contacting said tape conveying means.

3. The tape printer as claimed in claim 2, wherein said printing means includes a print head and first biasing means for normally biasing said print head in said first position.

4. The tape printer as claimed in claim 3, wherein said tape conveying means includes a tape conveying roller and second biasing means for biasing said tape conveying roller in said first position.

5. The tape printer as claimed in claim 1, wherein said printing means includes a thermal print head.

6. The tape printer as claimed in claim 1, further including a tape cassette being insertable in and removable from said tape printer having an opening sized to receive said printing means, said printing means extending into said opening when said tape cassette is inserted in said housing.

7. The tape printer as claimed in claim 6, wherein said tape is wound on a first roller, said tape cassette including a tape pressing roller for guiding said tape from said first roller, said tape conveying means including a tape conveying roller which presses against said tape pressing roller when said cover means is in its closed position.

8. The tape printer as claimed in claim 6, wherein said housing includes first and second position-determining shafts for positioning said tape cassette in said housing.

9. The tape printer as claimed in claim 6, wherein said tape cassette includes an ink ribbon supported therein.

10. The tape printer as claimed in claim 9, wherein said ink ribbon is supported in an ink ribbon cassette, said tape cassette including a first opening for removably receiving said ink ribbon cassette.

11. The tape printer as claimed in claim 10, wherein said ink ribbon cassette includes a second opening, said printing means extending through said first opening in said tape cassette and said second opening in said ribbon cassette when said tape and ribbon cassettes are inserted in said housing.

12. The tape printer as claimed in claim 11, wherein said housing includes first and second position-determining shafts for positioning said tape cassette in said housing and third and fourth position-determining shafts for positioning said ribbon cassette in said housing in said first opening in said tape cassette.

13. The tape printer as claimed in claim 11, wherein said printing means includes a print head and first biasing means for normally biasing said print head in said first position.

14. The tape printer as claimed in claim 1, wherein said tape conveying means includes a tape conveying roller and biasing means for biasing said tape conveying roller in said first position.

15. The tape printer as claimed in claim 12, wherein said printing means includes a thermal print head.

16. The tape printer as claimed in claim 12, wherein said tape cassette includes an opening sized to receive said printing means, said printing means extending into said opening when said tape cassette is inserted in said housing.

17. The tape printer as claimed in claim 16, wherein said tape is wound on a first roller, said tape cassette including a tape pressing roller for guiding said tape from said first roller, said tape conveying means including a tape conveying roller which presses against said tape pressing roller when said cover means is in its closed position.

18. The tape printer as claimed in claim 7, wherein said housing includes first and second position-determining shafts for positioning said tape cassette in said housing.

19. The tape printer as claimed in claim 12, wherein said displacing means includes cam means supported on said cover means and lever means slidably disposed on said housing and contacting said cam means, said lever means having a first portion for contacting said printing means and a second portion for contacting said tape conveying means.

20. A tape printer for printing on a tape comprising a housing, printing means supported on said housing for printing on said tape, tape conveying means supported on said housing for conveying said tape across said printing means, a tape cassette insertable in and removable from said printer and carrying said tape therein, said tape cassette having an opening therein, an ink ribbon cassette removably supported in said opening in said tape cassette, said ink ribbon cassette carrying an ink ribbon therein, and winding means for winding said ink ribbon, first positioning means on said housing for positioning said tape cassette in a predetermined position in said housing, and drive means supported on said housing for driving said tape conveying means and said winding means, at least a portion of said tape conveying means being supported on said tape cassette and at least a portion of said winding means being supported on said ink ribbon cassette, whereby said tape cassette and ink ribbon cassette can each be replaced without replacing the other

21. The tape printer as claimed in claim 20, wherein said ribbon cassette includes a second opening sized to receive said printing means, said printing means extending into said second opening when said ribbon cassette is inserted in said housing.

22. The tape printer as claimed in claim 21, wherein said first positioning means includes at least first and second position-determining shafts extending from said housing, said tape cassette including first and second holes corresponding to the respective positions of said first and second positioning-determining shafts through which said first and second position-determining shafts respectively extend when said tape cassette is inserted in said housing.

23. The tape printer as claimed in claims 22, and including second positioning means on said housing for positioning said ribbon cassette in said opening in said tape cassette and on said housing, said second positioning means including third and fourth position-determining shafts extending from said housing, said ribbon cassette including third and fourth holes corresponding to the respective positions of said third and fourth position-determining shafts through which said third and fourth position-determining shafts respectively extend when said ribbon cassette is inserted in said housing.

24. The tape printer as claimed in claim 20, wherein said first positioning means includes at least first and second position-determining shafts extending from said housing, said tape cassette including first and second holes corresponding to the respective positions of said first and second positioning-determining shafts through which said first and second position-determining shafts through which said first and second position-determining shafts respectively extend when said tape cassette is inserted in said housing.

25. The tape printer as claimed in claim 24, and including second positioning means on said housing for positioning said ribbon cassette in said opening in said tape cassette and on said housing, said second positioning means including third and fourth position-determining shafts extending from said housing, said ribbon cassette including third and fourth holes corresponding to the respective positions of said third and fourth position-determining shafts through which said third and fourth position-determining shafts respectively extend when said ribbon cassette is inserted in said housing.

26. The tape printer as claimed in claim 20, and including second positioning means on said housing for positioning said ribbon cassette in said opening in said tape cassette and on said housing, said second positioning means including first and second position-determining shafts extending from said housing, said ribbon cassette including first and second holes corresponding to the respective positions of said first and second position-determining shafts through which said first and second position-determining shafts respectively extend when said ribbon cassette is inserted in said housing.

27. The tape printer as claimed in claim 20, wherein said opening in said tape cassette is sized to define a gap with said ribbon cassette when said ribbon cassette is inserted in said opening.

28. The tape printer as claimed in claim 27, wherein said ribbon cassette includes a second opening sized to receive said printing means, said printing means extending into said second opening when said ribbon cassette is inserted in said housing.

29. The tape printer of claim 20 and including displacing means supporting said printing means on said housing for displacement between a first position where said printing means is adjacent said tape for printing thereon and a second position where said printing means is disengaged from said tape, said displacing means supporting a portion of said tape conveying means on said housing for displacement between a first position where said printer portion of said tape conveying means is engaged with said tape for conveying said tape and a second position where said printer portion of said tape conveying means is disengaged from said tape, cover means pivotally supported on said housing for covering said tape printer and pivotal between a first open position and a second closed position, said displacing means being separate from but operatively coupled to said cover means for the displacement of said displacing means between said first and second positions of said printing means and printer portion of said tape conveying means in response to the pivoting of said cover means between said closed and open positions, whereby said cover means moves said printing means and the printer portion of said tape conveying means to their respective second disengaged positions when open and moves said printing means and said tape conveying means to their respective first engaged positions when closed.

30. The tape printer as claimed in claim 29, wherein said displacing means includes can means supported on said cover means and lever means slidably disposed on said housing and contacting said cam means, said lever means having a first portion for contacting said printing means an a second portion for contracting said tape conveying means.

31. The tape printer as claimed in claim 30, wherein said printing means includes a print head and first biasing means for normally biasing said print head in said first position.

32. The tape printer as claimed in claim 31, wherein said tape conveying means includes a tape conveying roller and second biasing means for biasing said tape conveying roller in said first position.

33. The tape printer as claimed in claim 20, wherein said printing ,means includes a thermal print head.

34. A tape cassette including a tape for use in a tape printer having a print head and drive means for advancing said tape across said print head, said tape cassette comprising a housing adapted for removable mounting in the tape printer, said tape being wound and supported in said housing, tape conveying means supported in said housing for cooperation with said drive means for advancing said tape across said print head, said tape conveying means including first and second opposing roller means both rotatably supported in said housing, said tape extending intermediate said first and second roller means, said first roller means being selectively driven by said printer drive means when said tape cassette is in said tape printer, said second roller means including guide means for preventing movement of said tape in a vertical direction, and biasing means for biasing said first roller means against said second roller means.

35. The tape cassette as claimed in claim 34 wherein said housing includes an opening therein through which said print head extends when said housing is supported on said printer.

36. The tape cassette as claimed in claim 35, wherein said tape cassette includes an ink ribbon which extends across said opening.

37. The tape cassette as claimed in claim 34, wherein said biasing means is a spring.

38. The tape cassette as claimed in claim 37, wherein said tape cassette includes a separator, said separator being pressed against said second roller means by said spring to press said second roller means against said first roller means.

39. A tape cassette including a tape from use in a tape printer having a print head and drive means for advancing said tape across said print head, said tape cassette comprising a housing adapted to be removably mounted in the tape printer, said tape being wound and supported in said housing, tape conveying means mounted in said housing for cooperation with said drive means for advancing said tape across said print head, and a platen roller freely rotatably supported on said housing for positioning in opposed relation to said print head when said tape cassette is mounted in said tape printer with said tape between said print head and platen, said tape cassette having an opening sized to receive said print head, said print head extending into said opening when said tape cassette is mounted in said printer, said tape cassette further including an ink ribbon supported therein for extending intermediate said print head and said tape and platen roller, a ribbon cassette for supporting said ink ribbon, said ribbon cassette being removably mounted within said opening in said housing and being formed with an opening therein for receipt of said print head.

40. The tape cassette of claim 39, wherein said tape is a two component tape, one component being a carrier tape and the other component being a print receiving tape, each of said tape components being supported in said housing, said tape conveying means including means for advancing each of said tape components.

41. A tape and ink ribbon cassette assembly, including a tape and ink ribbon for use in a tape printer having a print head and drive means for advancing said tape across said print head and for advancing said ink ribbon, comprising a housing adapted for removable mounting in the tape printer, said tape being wound and supported in said housing, a tape conveying means mounted in said housing for cooperation with said drive means for advancing said tape across said print head, an ink ribbon cassette supporting said ink ribbon for advancing across said print head, said tape cassette including a first opening for removably receiving said ink ribbon cassette, said ink ribbon cassette including an ink ribbon cassette housing adapted to be removably mounted in said opening in said tape cassette housing, said ink ribbon being wound and supported in said ink ribbon cassette housing, and an ink conveying means mounted in said ink ribbon cassette for cooperation with said drive means for advancing said ink ribbon across said print head, whereby said tape housing and ink ribbon cassette can each be replaced without replacing the other.

42. The tape and ink ribbon cassette of claim 41, wherein said ink ribbon cassette includes an opening therein, sized to receive said print head, said print head extending into said opening when said tape and ribbon cassette is inserted in the tape printer.

43. The tape printer of claim 42, and including a freely rotatable platen roller supported on said housing and positioned for cooperation with said print head with said tape and ink ribbon therebetween when said tape and ink ribbon cassette is mounted in the tape printer.

44. The tape and ink ribbon cassette as recited in claim 43, wherein said tape is a two component tape, one component being a carrier tape and the other component being a print receiving tape, each of said tape components being supported in said housing, said tape conveying means including means for advancing each of said tape components.

45. The tape printer of claim 1, and including a freely rotatable platen roller supported on said tape cassette and positioned for engagement by said printing means through said tape when said printing means is in said first position.

46. A tape printer as recited in claim 20, and including a freely rotatable platen mounted on said tape cassette for cooperation with said printing means during printing.

* * * * *